US005377877A

United States Patent [19]

Brown et al.

[11] Patent Number: 5,377,877

[45] Date of Patent: * Jan. 3, 1995

[54] DISPENSING VALVE FOR PACKAGING

[75] Inventors: Paul E. Brown, Midland; Timothy R. Socier, Essexville, both of Mich.

[73] Assignee: Liquid Molding Systems, Inc., Midland, Wis.

[ * ] Notice: The portion of the term of this patent subsequent to May 25, 2010 has been disclaimed.

[21] Appl. No.: 52,113

[22] Filed: Apr. 23, 1993

Related U.S. Application Data

[63] Continuation-in-part of Ser. No. 804,086, Dec. 6, 1991, Pat. No. 5,213,236.

[51] Int. Cl.[6] ..... B65D 35/56

[52] U.S. Cl. ..... 222/105; 220/89.1; 220/203; 222/185; 222/212; 222/490; 222/493; 222/494; 222/496

[58] Field of Search ..... 222/92, 105, 181, 185, 222/206, 212, 215, 490, 491, 492, 493, 494, 495, 496; 220/89.1, 203, 205

[56] References Cited

U.S. PATENT DOCUMENTS

| | | | |
|---|---|---|---|
| 1,206,661 | 11/1916 | Booth . | |
| 1,825,553 | 9/1931 | Smith . | |
| 1,989,714 | 2/1935 | Statham | 221/60 |
| 2,175,052 | 10/1939 | Bull et al. | 221/60 |
| 2,758,755 | 8/1956 | Schafler | 222/213 |
| 3,342,379 | 9/1967 | Foley | 222/173 |
| 3,490,488 | 1/1970 | Grist | 220/203 |
| 3,921,630 | 11/1975 | McPhee | 222/107 X |
| 4,088,166 | 5/1978 | Miller | 222/107 X |
| 4,166,553 | 9/1979 | Fraterrigo | 222/181 |
| 4,340,054 | 7/1982 | Michaels | 222/105 X |
| 4,408,702 | 10/1983 | Horvath | 222/212 |
| 4,434,810 | 3/1984 | Atkinson | 137/493 |
| 4,470,523 | 9/1984 | Spector | 222/181 |
| 4,728,006 | 3/1988 | Drobish et al. | 222/181 |
| 4,747,519 | 5/1988 | Green et al. | 222/181 |
| 4,749,108 | 6/1988 | Dornsbusch et al. | 222/212 |
| 4,987,740 | 1/1991 | Coleman | 220/203 |
| 5,033,655 | 6/1991 | Brown | 222/212 |
| 5,071,017 | 12/1991 | Stull | 220/203 X |
| 5,115,950 | 5/1992 | Rohr | 220/494 |
| 5,203,470 | 4/1993 | Brown | 222/105 X |

FOREIGN PATENT DOCUMENTS

| | | | |
|---|---|---|---|
| 996998 | 12/1951 | France . | |
| 2128875 | 12/1972 | Germany . | |
| 2609310 | 9/1976 | Germany . | |
| 3941668 | 4/1991 | Germany | 222/92 |
| 1046518 | 10/1966 | Switzerland . | |
| 2098958 | 12/1982 | United Kingdom . | |
| 0278125 | 8/1988 | United Kingdom . | |
| 0395380 | 10/1990 | United Kingdom . | |
| 145824 | 3/1962 | U.S.S.R. . | |

*Primary Examiner*—Andres Kashnikow
*Assistant Examiner*—Joseph A. Kaufman
*Attorney, Agent, or Firm*—Price, Heneveld, Cooper, DeWitt & Litton

[57] ABSTRACT

A dispensing package is provided for fluid products such as liquid soaps, shampoos and conditioners, household detergents, cleaners, polishes, moisturizing creams, and the like, and includes a container with a self-sealing dispensing valve mounted therein. The valve includes a marginal flange, a valve head with a discharge orifice therein, and a connector sleeve having one end connected with the valve flange and the opposite end connected with the valve head adjacent a marginal edge thereof. The connector sleeve has a resiliently flexible construction, such that when pressure within the container raises above a predetermined amount, the valve head shifts outwardly in a manner which causes the connector sleeve to double over and extend rollingly.

42 Claims, 13 Drawing Sheets

DISPENSING VALVE FOR PACKAGING

CROSS REFERENCES TO RELATED APPLICATIONS

The present application is a continuation-in-part of commonly assigned, co-pending U.S. patent application Ser. No. 804,086, filed Dec. 6, 1991, entitled DISPENSING VALVE FOR PACKAGING (now U.S. Pat. No. 5,213,236), and related, similarly titled continuation-in-part application Ser. No. 08/039,896, filed Mar. 30, 1993 now U.S. Pat. No. 5,339,995, which applications are hereby incorporated by reference.

BACKGROUND OF THE INVENTION

The present invention relates to product packaging, and in particular to a self-sealing valve for fluid products, and the like.

Many different types of packages or containers are presently available for packaging non-solid products of the type which are capable of flowing, such as fluid or fluidized materials, including liquids, pastes, powders, and the like, which substances are collectively and generically referred to herein as "fluids". Some such packages include a dispenser which permits a selected amount of fluid to be discharged from the package, and then reseals to close the package.

Self-sealing dispensing valves have been used in packaging for certain types of products, such as the container disclosed in U.S. Pat. No. 4,728,006 to Drobish et al, which is designed for shampoos, conditioners, and the like. However, such valves have been known to experience some types of sealing problems, and inconsistent dispensing characteristics, particularly when the packages are exposed to significant temperature variations.

Valves constructed from most conventional plastic materials cannot be used in at least certain types of packages, since they either react with or adulterate the product. For instance, in food packaging, care must be taken to avoid the use of valve materials which might contain any type of toxin. Furthermore, active ingredients in products can cause the valve to either embrittle or soften, thereby ruining the designed flow rate and/or self-sealing characteristics of the valve.

Liquid silicone rubber valves have recently been used in some types of packaging, and have proven particularly advantageous since the material is inherently quite inert, and will therefore not either adulterate or react with the packaged product. Examples of such packaging are provided in applicant's U.S. Pat. No. 5,033,655 to Brown. Although liquid silicone rubber possesses many attributes for use in packaging, it also has other characteristics which render such applications problematic. For example, the surfaces of liquid silicone rubber parts are extremely tacky or sticky, having a very high coefficient of friction. As a result, in attempting to attach a dispensing valve to a container by a conventional threaded collar arrangement, the surfaces of the valve flange will stick tightly to the adjacent surfaces of the container and collar before the collar can be tightened securely enough to create a leak-resistant seal. Tightening of the collar often causes the valve flange, as well as the entire valve to distort from its designed shape, thereby preventing the formation of a secure seal, and/or changing the intended dispensing and sealing characteristics of the valve.

Another drawback associated with the use of liquid silicone rubber in dispensing valves for product packaging is that there is presently no available adhesive capable of connecting the valve to a container in a manner that will withstand the operating pressures to which the valve and container are repeatedly subjected. The unique imperforate nature of the surfaces of the liquid silicone rubber valve precludes the use of conventional adhesives. Hence, the attachment of the liquid silicone rubber valve to a container in a manner that will not leak, and will withstand repeated pressurization and depressurization of the dispensing package is an important consideration.

Another problem experienced with prior dispensing packages relates to achieving a proper design balance between the package container, valve, and fluid product, so that the product can be repeatedly dispensed without requiring excess force, and will neatly discharge only that amount of product which is desired by the user, particularly in keeping with the type of product involved. For instance, when dispensing highly concentrated fluid products, such as hand soaps, and the like, the user will typically require only a small amount or dollop of soap per application to achieve satisfactory results. In contrast, when using other types of fluid products, such as skin moisturizers, tanning formulas, and the like, larger quantities of product are typically required by the user for each application. The ability of the valve to quickly and readily open in response to moderate pressure on the container is important, as is the ability of the valve to quickly and securely close when the pressure has been released. Also important is the amount of pressure which must be maintained on the container to sustain fluid through the valve once the valve is opened. The ability to quickly and accurately achieve a proper balance between all of these factors is very desirable in designing dispensing packages.

SUMMARY OF THE INVENTION

One aspect of the present invention is a dispensing package for fluid products and the like, comprising a container having a dispensing valve mounted therein. The dispensing valve includes a marginal flange which seals about a discharge opening of the container, and a valve head with an orifice therethrough which opens and closes in response to the application and release of a predetermined discharge pressure to control fluid flow therethrough. The valve includes a connector sleeve having one end connected with the valve flange, and an opposite end connected with the valve head adjacent a marginal edge thereof. The connector sleeve has a resiliently flexible construction, whereby when pressure within the containers raised above the predetermined discharge pressure, the valve head shifts outwardly in a manner which causes the connector sleeve to double over and then extend rollingly, and thereby apply a torque to the valve head which assists in opening the orifice.

Another aspect of the present invention is a dispensing valve for fluid product packaging and the like, having a marginal valve flange shaped to seal about a discharge opening of the container. The valve includes a valve head having a marginal edge, interior and exterior sides, and an orifice extending therebetween which opens to permit fluid flow therethrough in response to communication with a predetermined discharge pressure, and closes to shut off fluid flow therethrough upon removal of the predetermined discharge pressure. A connector sleeve with a resiliently flexible construction, has one end connected with the valve flange, and the opposite end connected with the valve head adjacent to the marginal edge thereof, whereby when pressure in excess of the predetermined discharge pressure is applied to the interior side of the valve head, the valve head shifts outwardly in a manner which causes the connector sleeve to double over and then extend rollingly, and thereby apply a torque to the valve head which assists in opening the orifice.

Yet another aspect of the present invention is a dispensing package for fluid products and the like, comprising a container having a dispensing valve mounted therein for controlling the flow of fluid product from the container. The dispensing valve includes a marginal valve flange, a valve head with an orifice which permits fluid flow therethrough, and a connector sleeve having one end connected with the valve flange, and an opposite end connected with the valve head adjacent a marginal edge thereof, such that the dispensing valve assumes a generally hat-shaped, side elevational configuration which normally projects inwardly toward the interior of the container. The connector sleeve has a resiliently flexible construction which permits the valve head to shift outwardly through the valve flange by doubling over the connector sleeve, which then extends rollingly outwardly.

Yet another aspect of the present invention is a dispensing valve, comprising a marginal valve flange, and a valve head with an orifice therethrough which selectively opens to permit fluid flow in response to communication with a predetermined discharge pressure. The valve head is configured such that it assumes an outwardly protruding orientation when the orifice is open. The dispensing valve also includes a connector sleeve, which has a resiliently flexible construction, with one end connected with the valve flange, and an opposite end connected with the valve head adjacent the marginal edge thereof, whereby when pressure in excess of the predetermined discharge pressure is applied to the interior side of the valve head, the valve head shifts outwardly in a manner which causes the connector sleeve to double over and then extend rollingly, and thereby apply a torque to the valve head which resiliently snaps the valve head into its outwardly protruding orientation to quickly and fully open the orifice.

Yet another aspect of the present invention is a self-sealing dispensing valve for fluid product packaging and the like, comprising a marginal valve flange, and a valve head with an orifice therein which selectively permits fluid flow through the valve. The interior side of the valve head has an outwardly curving arcuate side elevational shape defined by a first radius, while the exterior side of the valve head has an outwardly curving arcuate side elevational shape defined by a second radius, which is less than the first radius. A connector sleeve is provided with a resiliently flexible construction, and has one end connected with the valve flange, and the opposite end connected with the valve head.

Yet another aspect of the present invention is a self-sealing dispensing valve for fluid product packaging and the like, comprising a marginal valve flange, and a valve head having a discharge opening therein to selectively permit fluid flow. The valve head includes an exterior side having an outwardly curving arcuate side elevational shape defined by a first radius, and an interior side with a center portion having a generally flat side elevational shape, and a marginal portion having an outwardly curving arcuate side elevational shape defined by a second radius, which is greater than the first radius. The discharge orifice extends from the center portion of the exterior surface to the interior surface of the valve head to achieve easy and complete opening of the discharge orifice when the predetermined discharge pressure is applied thereto, and secure and complete closing of the discharge opening when the predetermined discharge pressure is released.

Yet another aspect of the present invention is a dispensing valve for fluid product packaging, comprising a marginal valve flange, and a valve head having an orifice therein which opens to permit fluid flow therethrough in response to a predetermined discharge pressure, and closes to shut off fluid flow therethrough upon removal of the predetermined discharge pressure. The dispensing valve includes a substantially imperforate rolling diaphragm positioned between and interconnecting the valve flange and the valve head, which has a flexible construction which permits the valve head to shift between a retracted position on an interior side of the marginal flange for storage, and an extended position on an exterior side of the marginal flange for dispensing. When pressure in excess of the discharge pressure is applied to the container, the valve head first shifts to the extended position, and then opens the orifice to discharge the fluid product therethrough. Upon release of the pressure, the orifice first closes to shut off the flow of fluid product therethrough, and the valve head then shifts to the retracted position for storage.

Yet another aspect of the present invention is a valve, comprising a marginal valve flange, and a valve head having a marginal edge, interior and exterior sides, and an orifice extending therebetween which in response to communication with a predetermined discharge pressure, shifts to a fully open position to permit fluid flow therethrough. A connector sleeve is provided, having a resiliently flexible construction, with one end connected with the valve flange, and an opposite end connected with the valve head adjacent the marginal edge thereof, which permits the valve head to shift with respect to the marginal valve flange in a manner which causes the connector sleeve to double over and then extend rollingly, and thereby apply an outwardly directed torque to the valve head which tends to open the orifice. The valve head is configured with a plan shape which expands or dilates as the orifice is shifted to the fully open position, which expansion is resisted by the connector sleeve, so as to inwardly compress the valve head, which inward compression and torque applied to the valve head by the connector sleeve combine to resiliently maintain the orifice in the fully open position, whereby that pressure required to maintain fluid flow through the orifice is substantially less than the predetermined threshold pressure, so as to provide greater ease of dispensing and flow control.

Yet another aspect of the present invention is a dispensing valve for containers of the type having walls which collapse when fluid product is dispensed therefrom. The dispensing valve includes a marginal valve portion, a valve head portion with an orifice which permits fluid flow therethrough, and a connector sleeve portion having one end area thereof connected with the marginal valve portion, and the opposite end area thereof connected with the valve head portion. The valve head portion is shaped for shifting generally centrally with respect to the marginal valve portion, and a connector sleeve portion has a configuration which applies an outwardly directed torque to the valve head portion when pressure within the container is raised above a predetermined discharge pressure to assist in opening the orifice, and applies an inwardly directed torque to the valve head portion when the predetermined discharge pressure within the container is released to assist in closing the orifice.

Yet another aspect of the present invention is a dispensing valve for fluid product packaging and the like, having an improved flange design. The dispensing valve includes a valve head portion having an orifice which permits fluid flow therethrough, and a marginal flange portion having a first surface oriented to face generally toward the valve head portion, and a second surface oriented to face generally away from the valve head portion. One of the two flange surfaces is shaped for sealing abutment with a valve seat in the container. The second flange surface has a support edge area projecting outwardly away from the valve head portion to a location exteriormost of the valve, and is configured to abut a conveying surface, and support the valve thereon in a predetermined upright orientation. During handling of the valve, such as for assembly in an associated container, the valve is positioned on the conveying surface in the upright orientation with the support edge area in abutment with the conveying surface, which establishes minimum contact therebetween to facilitate reliably translating the valve along the conveying surface while retaining the valve in its upright orientation.

Yet another aspect of the present invention is a dispensing valve for fluid product packaging and the like, having a crown shaped valve head design. The dispensing valve includes a marginal valve portion, a connector sleeve portion having a resiliently flexible construction, with one end area thereof connected with the marginal valve portion, and a valve head portion connected with an opposite end area of the connector sleeve portion. The valve head portion has an orifice which selectively permits fluid flow therethrough, and includes an outwardly flared crown shape which alleviates nesting, and improves air suck back without sacrificing desirable closing characteristics.

Yet another aspect of the present invention is a dispensing package for fluid products and the like, having an improved bottom dispense design. A container is provided having a base shaped to support the same in an upright, freestanding orientation on a selected surface, and including a dispensing valve mounted in a base portion thereof for bottom dispensing. The dispensing valve includes a marginal valve portion, a valve head portion having an orifice therein which selectively permits fluid flow therethrough, and a connector sleeve portion having a resiliently flexible construction, with one end area thereof connected with the marginal valve portion, and an opposite end area thereof connected with the valve head portion. The dispensing valve is configured such that the predetermined threshold pressure necessary to open the valve is greater than the maximum hydraulic head pressure of the fluid product in the container when the discharge opening is oriented downwardly, so as to prevent inadvertent leakage of the liquid product from the dispensing package.

Yet another aspect of the present invention is a dispensing package for fluid products and the like, having a leak resistant valve stop. A container is provided having a dispensing valve mounted about a discharge opening therein. The dispensing valve includes a marginal valve portion, a valve head portion having an orifice which selectively permits fluid flow therethrough, and a connector sleeve portion having a resiliently flexible construction, with one end area thereof connected with the valve marginal portion, and an opposite end area thereof connected with the valve head portion. The connector sleeve portion has a sidewall configuration which extends to shift the valve head portion. outwardly when pressure within the container is raised above a predetermined discharge pressure. A valve stop is provided which is selectively connected with the container generally opposite the dispensing valve, and includes an inwardly projecting protuberance positioned to positively retain the orifice in its fully closed position.

The principle objects of the present invention are to provide a dispensing package which is capable of easily and neatly dispensing a wide variety of different types of fluid products. The dispensing package includes a self-sealing valve which is matched with both the container and the type of fluid product to be dispensed, so as to quickly and securely seal, yet readily and fully open when the user applies modest pressure to the container. The valve includes a resiliently flexible connector sleeve which is configured to double over and then extend rollingly, so as to apply a torque to the valve head which assists in opening the orifice. The connector sleeve has sufficient flexibility that pressure increases in the interior of the container, such as those caused by thermal expansion, are offset by shifting the valve head on the connector sleeve, so as to alleviate excess pressure on the orifice. The connector sleeve is also configured to provide sufficient flexibility that any misalignment and/or distortion of the valve flange when attached to the associated container are not transmitted to the valve head, thereby permitting unhindered opening and closing of the orifice. The connector sleeve is also configured to provide sufficient flexibility that shock impact forces, and the like applied to the container are absorbed by shifting the valve head on the connector sleeve, so as to avoid inadvertent opening of the valve orifice. The valve is configured to provide a generally constant flow rate therethrough, even when exposed to a relatively wide range of container pressures. For those products wherein a substantial amount of material is typically dispensed per application, the valve is configured such that once the orifice is shifted open, the amount of pressure required to maintain fluid flow through the orifice is reduced, so as to provide greater ease of operation, without sacrificing secure sealing of the valve. The dispensing package is extremely versatile, and particularly adapted for use in conjunction with bottom dispensing containers, and other similar packaging. The valve is very durable, while having reduced manufacturing costs, and an uncomplicated design. The overall package is efficient in use, economical to manufacture, capable of a long operating life, and particularly well adapted for many different proposed uses.

In addition to those advantages noted hereinabove, the present self-sealing valve can be used in conjunction with containers that have a resilient squeeze type of sidewall construction, as well as containers which have a collapsible sidewall construction. The configuration of the dispensing valve, particularly with respect to the resilient flexible connector sleeve, and associated valve head configuration, are such that the valve will shift to its fully closed position without requiring a negative pressure within the container. The valve may be provided with a uniquely shaped marginal flange, which has an outwardly projecting support edge area that facilitates conveying the valve, such as during assembly operations. Also, the dispensing valve may include a crown shaped valve head, which alleviates nesting during handling, and provides improved air suck back, without sacrificing desirable closing characteristics. The dispensing valve may also be used in conjunction with an improved bottom dispensing container, and may be provided with a valve stop having an inwardly projecting protuberance to positively retain the orifice in its fully closed position.

These and other advantages of the invention will be further understood and appreciated by those skilled in the art by reference to the following written specification, claims and appended drawings.

BRIEF DESCRIPTION OF THE DRAWINGS

FIG. 23 is an enlarged, partially schematic, top plan view of a plurality of the valves illustrated in FIGS. 19–22, shown on a conveyor for translation to an assembly station or the like.

DETAILED DESCRIPTION OF THE PREFERRED EMBODIMENTS

Figure 1:
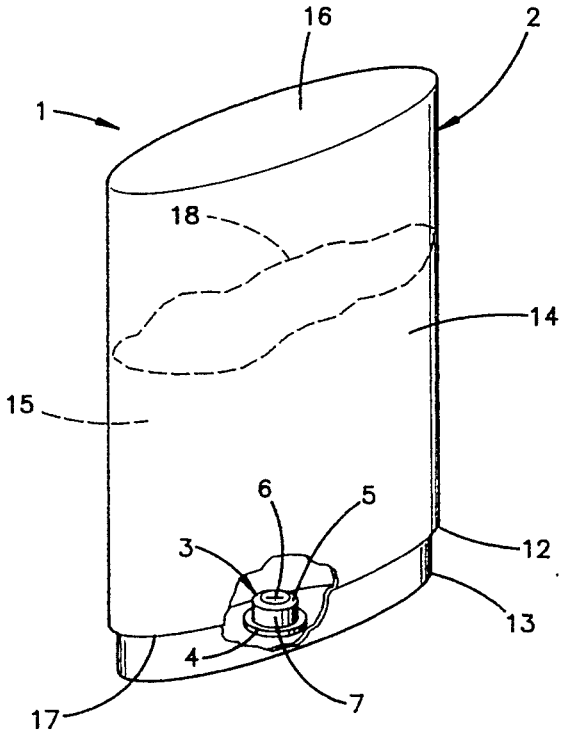
FIG. 1 is a perspective view of a dispensing package embodying the present invention, wherein a portion thereof has been broken away to reveal a self-sealing valve mounted in a bottom portion of an associated container.
Figure 2:
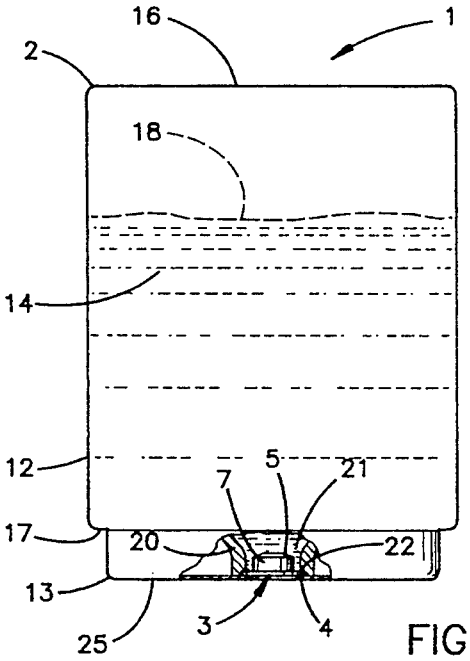
FIG. 2 is a side elevational view of the dispensing package, wherein a portion thereof has been broken away to reveal the valve, which is shown in a fully retracted and fully closed position.
Figure 3:
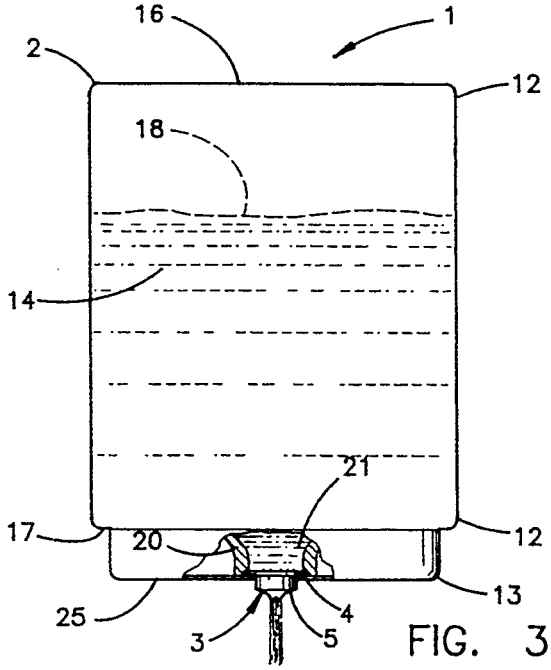
FIG. 3 is a side elevational view of the dispensing package, wherein a portion thereof has been broken away to reveal the valve, which is shown in a fully extended and fully open position.

For purposes of description herein, the terms "upper", "lower", "right", "left", "rear", "front", "vertical" "horizontal" and derivatives thereof shall relate to the invention as oriented in FIGS. 1–3. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a dispensing package embodying the present invention. Dispensing package 1 is particularly adapted for dispensing fluid products, such as liquid soaps, household cleaners, polishes, moisturizing creams, foodstuffs, and the like, and includes a container 2 with a unique self-sealing dispensing valve 3 mounted therein. Valve 3 includes a marginal flange portion 4, a valve head portion 5 with a discharge orifice 6 therein, and a connector sleeve portion 7, having one end area connected with valve flange portion 4, and the opposite end area connected with valve head portion 5 adjacent a marginal area thereof. Connector sleeve portion 7 has a resiliently flexible construction, such that when pressure within container 2 is raised above a predetermined amount, valve head portion 5 shifts outwardly (FIGS. 8–15) in a manner which causes connector sleeve portion 7 to double over and then extend rollingly.

The illustrated container 2 (FIGS. 1–3) is particularly designed for bottom dispensing, and includes a generally flexible, oblong container body 12 supported on a substantially rigid base 13. Container body 12 is preferably integrally molded from an appropriate synthetic resin material or the like, so as to create a one-piece construction that includes oppositely oriented sidewalls 14 and 15, a top 16 and a bottom 17. The container sidewalls 14 and 15 are laterally flexible to pressurize and depressurize the interior of container 2, and preferably have sufficient resilience or stiffness that they automatically return to their original shape upon release of any external forces which are applied to container 2 to dispense a fluid product 18 therefrom.

Figure 7:
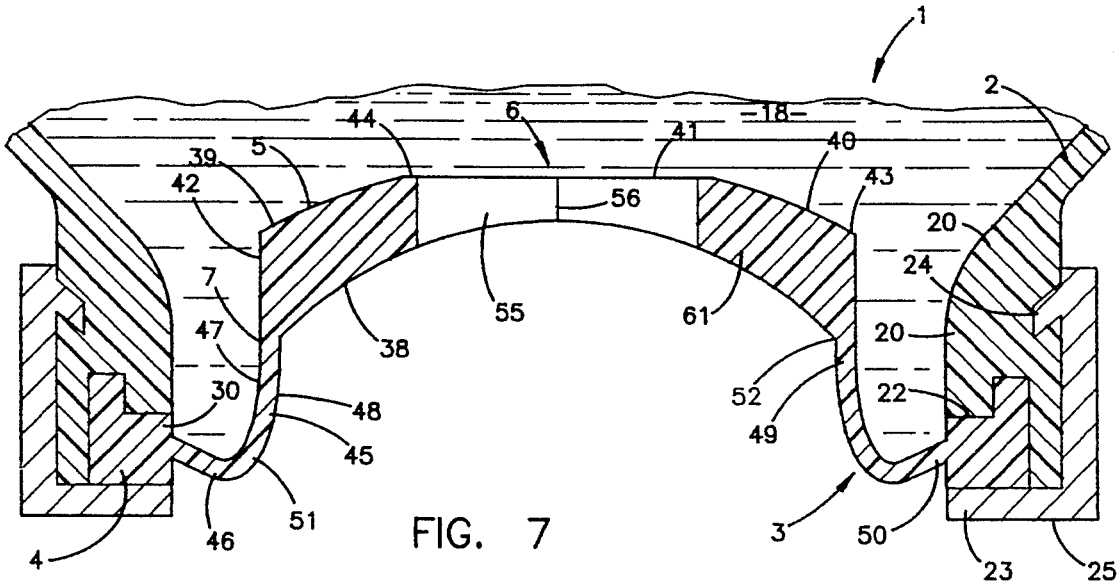
FIG. 7 is an enlarged, cross-sectional view of the valve installed in an associated container, with the valve shown in the fully closed and fully retracted position.
Figure 8:
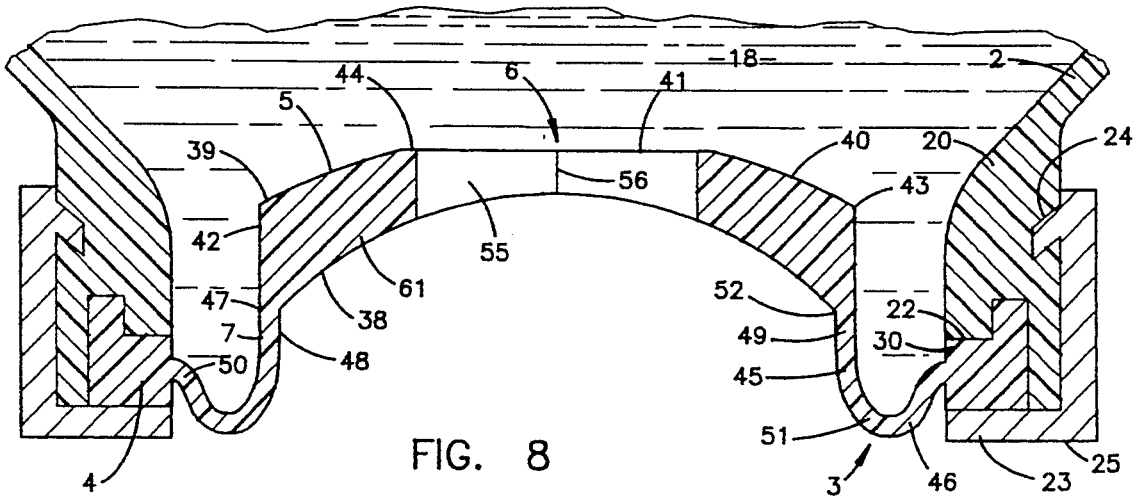
FIG. 8 is an enlarged, cross-sectional view of the valve installed in an associated container, with the valve shown in a fully closed, and partially retracted position.

The illustrated container bottom 17 (FIGS. 2 & 3) includes a downwardly opening neck 20, which defines a discharge opening 21 about which the marginal flange 4 of valve 3 is positioned. As best illustrated in FIG. 7 and 8, the free end of neck 20 includes an annularly shaped groove 22 having a general L-shaped longitudinal cross-sectional configuration, which is shaped to closely receive the marginal flange 4 of valve 3 therein. Container base 13 includes a valve retainer ring 23 positioned adjacent groove 22, and attached to container body 12 by a snap lock arrangement 24. Container base 13 (FIGS. 2 & 3) has a substantially flat bottom 25 adapted to abuttingly support dispensing package 1 on an associated surface, such as a countertop, sink, worksurface, or the like. Neck groove 22 is located inwardly of the bottom 25 of container base 13, so as to position valve 3 in a generally recessed condition within dispensing package 1, as explained in greater detail hereinafter. Container top 16 may be rounded or tapered to insure that container 2 is positioned in its upright orientation, as shown in FIGS. 1–3.

Figure 4:
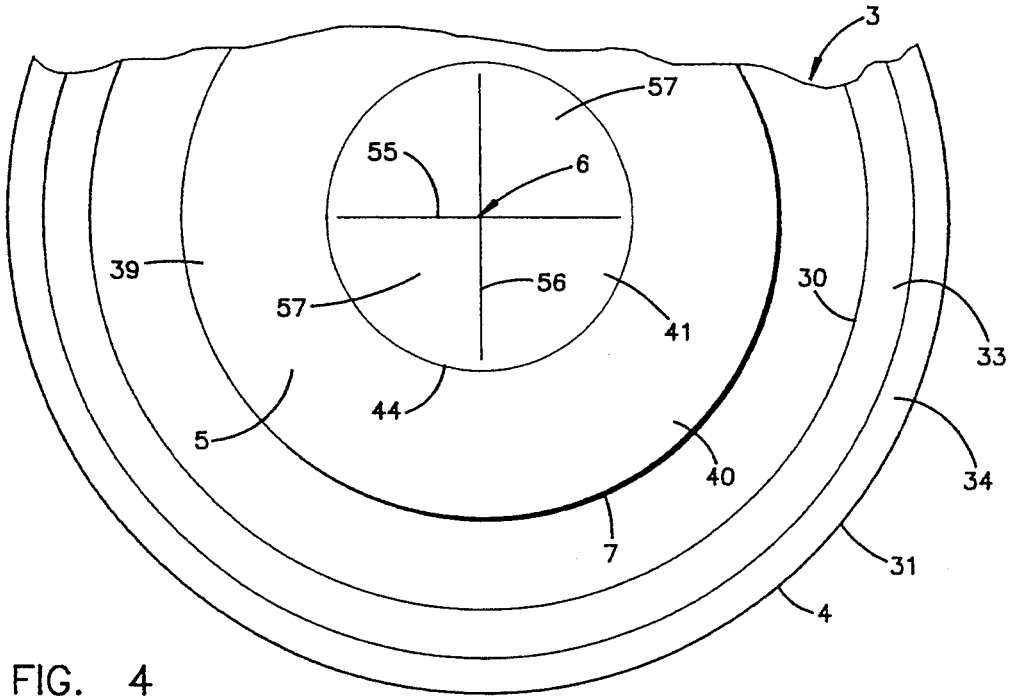
FIG. 4 is an enlarged, fragmentary top view of the valve.
Figure 5:
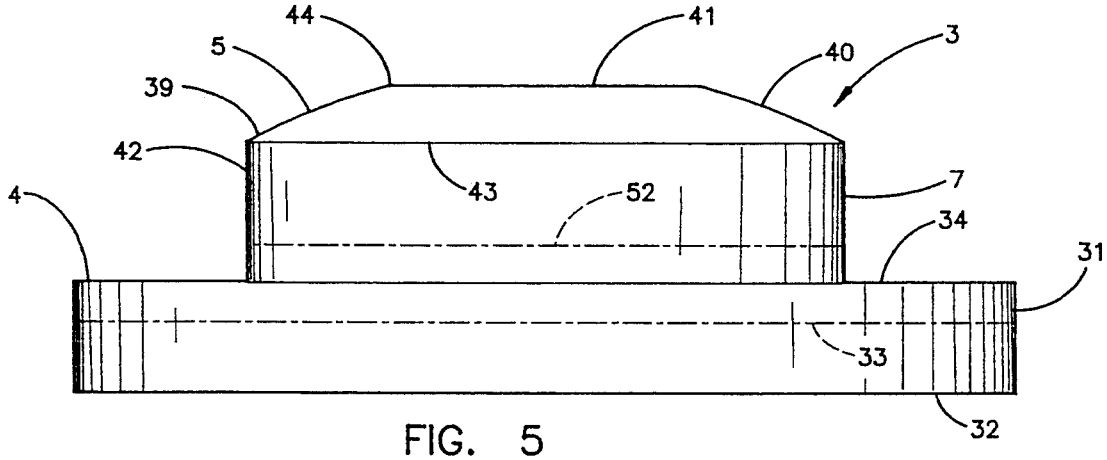
FIG. 5 is an enlarged, side elevational view of the valve.
Figure 6:
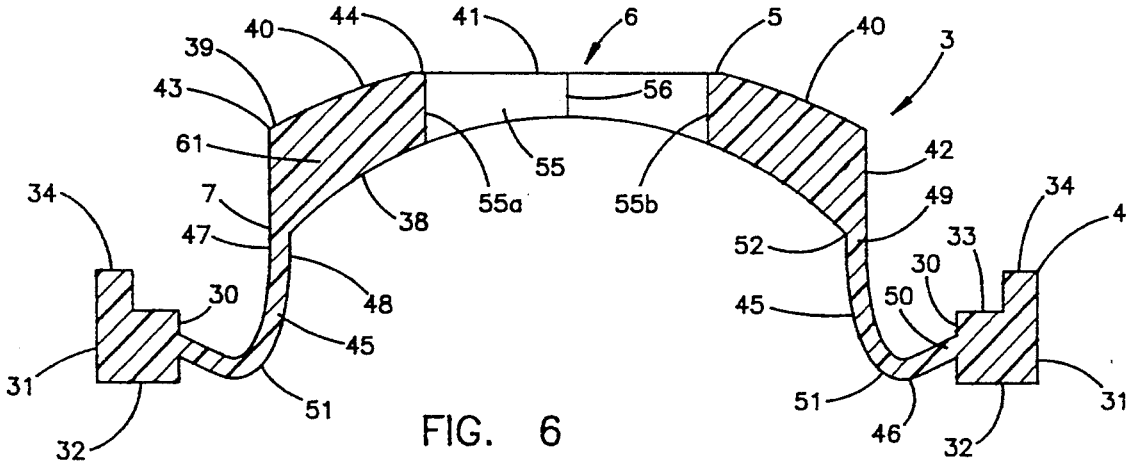
FIG. 6 is an enlarged, cross-sectional view of the valve.

With reference to FIGS. 4–6, the illustrated self-sealing dispensing valve 3 has an integrally formed, one-piece construction. Valve 3 has an interior side which interfaces with the fluid produce 18 in container 2, and an oppositely oriented exterior side which interfaces with ambient environment. Valve 3 is preferably molded from a resiliently flexible material, and in the illustrated example comprises a silicone rubber which is substantially inert so as to avoid reaction with and/or adulteration of the fluid product being packaged. In one working embodiment of the present invention, valve 3 is produced at relatively high speeds through the molding of liquid silicone rubber.

The illustrated marginal flange portion 4 (FIGS. 4–6) of valve 3 has an annular plan shape, and a substantially L-shaped cross-sectional configuration, comprising an inner edge 30, an outer edge 31, a bottom 32, and a top 33 with an outer rim 34 upstanding therefrom. Marginal valve flange 4 has substantial thickness between the bottom 32 and top 33 which is resiliently compressed upon attachment of retainer ring 23 to form a secure leak-resistant seal therebetween. The rim portion 34 of valve flange 4 positively locks valve 3 in neck groove 22 to prevent any radial movement therebetween.

The illustrated head portion 5 (FIGS. 4–6) of valve 3 has a circular plan shape, and a generally tapered construction which is thicker at the radially outside portion of valve head 5, and thinner at the radially inside portion thereof. This tapered construction assists in achieving the snap open/snap close action of valve 3, as described below. More specifically, in the illustrated example, valve head 5 has an exterior side or surface 38, which has an arcuately shaped side elevational configuration which opens or curves outwardly, toward the exterior of dispensing package 1, and is defined by a first, predetermined radius. Valve head exterior surface 38 extends continuously between the interior sidewalls of connector sleeve 7. Valve head 5 also includes an interior side or surface 39, which has a marginal portion 40 with an arcuately shaped side elevational configuration which opens or curved outwardly, toward the exterior of dispensing package 1, and is defined by a second predetermined radius. The radius of marginal portion 40 on interior surface 39 is larger than that of exterior surface 38, such that the two surfaces converge toward the center of valve head 5, and provide the above-noted inwardly tapered construction of valve head 5. The interior surface 39 of valve head 5 also includes a center portion 41, which has a circular plan shape, with a substantially planar or flat side elevational configuration, oriented generally perpendicularly to discharge orifice 6. The center portion 41 of valve head 5 assists in improving the opening and closing characteristic of valve 3, as set forth below. The outer perimeter of valve head 5 is defined by a circular marginal edge 42, which begins at the outer edge 43 of marginal portion 40, and extends outwardly therefrom with a slight outward taper, ultimately merging into connector sleeve 7. The intersection of the marginal portion 40 and the center portion 41 of valve head 5 defines a circular edge 44. The outside diameter of valve head 5, as measured along marginal edge 42 is substantially smaller than the inside diameter of marginal flange 4, as measured along inner edge 30. As explained in greater detail below, this spacing between valve head 5 and marginal flange 4 permits valve head 5 to shift freely in an axial direction through the center of marginal flange 4.

The illustrated connector sleeve portion 7 (FIGS. 4–6) of valve head 5 is in the form of a rolling diaphragm, having a hollow circular plan configuration, and a generally J-shaped longitudinal cross-sectional shape, comprising a cylindrical sidewall portion 45, and a radially outwardly extending base portion 46. Connector sleeve 7 has interior and exterior surfaces 47 and 48 respectively, which are spaced equidistantly apart along the length thereof, such that connector sleeve 7 has a substantially uniform thickness. One end portion 49 of connector sleeve 7 is connected with the exterior surface 38 of valve head 5 adjacent the marginal edge 42 thereof, and the opposite end portion 50 of connector sleeve 7 is connected with the inner edge 30 of marginal valve flange 4. The interior surface 47 of connector sleeve 7 adjacent end 49 is positioned substantially coplanar and contiguous with the marginal edge 42 of valve head 5, while the opposite end 50 of connector sleeve 7 is connected with marginal valve flange 7 at a medial portion of inner edge 30, such that the base portion 46 of connector sleeve 7 flares in a radially inwardly direction from marginal valve flange 46, and also protrudes outwardly toward the exterior of dispensing package 1 at an arcuate portion 51 of connector sleeve 7. The arcuately flared shape of connector sleeve portion 51 assists connector sleeve 7 in first doubling over, and then rollingly extending as valve head 5 shifts outwardly in the manner described in greater detail below. The marginal attachment point of end 49 of connector sleeve 7 to valve head 5, as well as its associated geometry, increases the effectiveness of torque forces which assist in snapping valve 3 open, as discussed hereinafter. The exterior surface 48 of sleeve side wall 45 at end 49 of connector sleeve 7 intersects the exterior surface 38 of valve head 5 at an angle which defines a circular edge 52. In the illustrated example, the exteriormost area of sleeve arcuate portion 51 is disposed substantially in-line with or slightly interior of the bottom 32 of marginal flange 4, so as to facilitate fabrication. The length of connector sleeve 7 is preferably selected sufficiently short to prevent the same from folding in behind valve head 5 when valve head 5 is in the fully extended position (FIGS. 10–14), thereby avoiding interference with the retraction of valve head 5, which is explained in detail below.

The illustrated one-piece valve 3 has a hat-shaped side elevational configuration in its original, normal condition, wherein valve head 5 assumes a generally concave shape. The resilient flexibility of connector sleeve 7 permits the same to double over and then extend rollingly in the manner described hereinafter. Connector sleeve 7 acts as a rolling diaphragm with valve head 5 mounted at the center thereof in a manner which permits valve head 5 to shift or float freely inwardly and outwardly in an axial direction with respect to the opening 21 in container neck 20.

In the illustrated example, discharge orifice 6 (FIGS. 4–6) has a cross-slit construction which includes two, intersecting linear slits 55 and 56 that extend through the opposite sides 38 and 39 of center portion 41. The illustrated slits 55 and 56 are oriented in a mutually perpendicular relationship, and have their opposite ends 55*a* and 55*b* positioned slightly inwardly from the outer edge 44 of center portion 41. Orifice slits 55 and 56 define four flaps or pedals 57 which flex inwardly and outwardly to selectively permit the flow of fluid product through valve 3. Slits 55 and 56 are preferably formed by slicing through the center portion 41 of valve head 5, without removing any substantial amount of material therefrom, so that the opposite side faces 58 and 59 (FIGS. 13 & 14) of valve flaps 57 closely seal against one another when discharge orifice 6 is in its normally, fully closed position. The length and location of slits 55 and 56 can be adjusted to vary the predetermined opening and closing pressures of valve 3, as well as other dispensing characteristics of dispensing package 1. The side faces 58 and 59 of each valve flap 57 intersect at their free ends to define an end edge 60. That portion of valve head 5 disposed between marginal portion 40, marginal edge 42, slit ends 55*a* & 55*b*, and exterior surface 38 defines a ring portion 61 of the valve head 5, which functions in the manner described in detail hereinafter.

It is to be understood that orifice 6 may assume many different shapes, sizes and/or configurations in accordance with those dispensing characteristics desired. For example, orifice 6 may comprise a single slit, particularly when smaller or narrower streams are desired. Orifice 6 may also include three or more slits, particularly when larger or wider streams are desired, and/or the fluid product contains aggregates, such as some types of salad dressings, and the like. Other forms of orifices 6, such as holes, duck bills, etc. may also be incorporated into valve 3.

Self-sealing dispensing valve 3 is preferably especially configured for use in conjunction with a particular container 2, and a specific type of fluid product, so as to achieve the exact dispensing characteristics desired. For example, the viscosity and density of the fluid product are both important factors in designing the specific configuration of valve 3, as is the shape, size, and strength of container 2, particularly when dispensing package 1 is configured for bottom dispensing. The rigidity and durometer of the valve material, and size and shape of both valve head 5 and connector sleeve 7 are also important in achieving the desire dispensing characteristics, and should be carefully matched with both the container 2 and fluid material 18 to be dispensed therefrom.

One working embodiment of the present invention is particularly designed to dispense fluid household products therefrom, such as dishwasher detergents, liquid soap, moisturizing creams, foodstuffs, and the like. When such fluid product materials are to be dispensed from a blow molded, polypropylene container with valve 3 positioned at the bottom 4 thereof for bottom dispensing, one specific valve 3 found to be particularly suited is as follows. The outside and inside diameters of marginal valve flange 4 are 0.7000 and 0.5802 inches respectively, while the outside diameter of the marginal edge 42 of valve head 5 is 0.4391 inches, and the outside diameter of center portion 41 is around 0.2212 inches. The thickness of connector sleeve 7 is approximately 0.0130 inches, and has an overall height, as measured from the bottom 32 of marginal flange 4 to the edge 52 of valve head 5 of 0.1159 inches. The radius of valve head exterior surface 38 is 0.2900 inches, while the radius of the marginal portion 40 of interior surface 39 is 0.0350 inches. Hence, the total thickness of valve head 5 at marginal edge 42 is around 0.0778 inches and around 0.0350 inches at the middle of center portion 41. The overall height of valve 3, as measured from the bottom 32 of marginal flange 4 to the top of center portion 41 is approximately 0.2402 inches. Slits 55 and 56 have a length of around 0.2200 inches, and are centered squarely in valve center portion 41. The valve is molded integrally from a liquid silicone rubber of the type manufactured under the trademark "SILASTIC LSR" by Dow Corning Corporation.

Experimental tests conducted on valves having the above-identified specific dimensions and characteristics indicate that valve 3 snaps open when exposed to a pressure inside container 2 equal to approximately 25–28 inches of water. That pressure which causes valve 3 to snap open is generally referred to herein as the predetermined dispensing or opening pressure. Valve 3 will automatically snap closed when the interior pressure of container 2 drops below a pressure equal to approximately 16–18 inches of water. That pressure which causes valve 3 to snap closed is generally referred to herein as the predetermined closing pressure. While the noted valve 3 is open, a substantially constant flow or stream of fluid product is discharged through orifice 6, even when extra pressure is exerted on container 2.

It is to be understood that according to the present invention, valve 3 may assume many different shapes and sizes, particularly in keeping with the type of container 2 and fluid product to be dispensed therefrom. The predetermined opening and closing pressures of valve 3 may be varied widely in accordance with those dispensing criteria desired for a particular product. Flow characteristics of the dispensed fluid product can also be adjusted substantially, such as for relatively wide column-like streams, thin needle-like streams, dollops, and the like.

In operation, dispensing package 1 functions in the following manner. Valve 3 normally assumes the inwardly protruding orientation illustrated in FIG. 7, wherein valve 3 remains substantially in its original molded shape without deformation, with connector sleeve 7 being fully retracted and discharge opening 6 being fully closed. When valve 3 is mounted in the bottom of container 2, as is shown in the illustrated bottom dispensing package 1, valve 3 is configured such that discharge orifice 6 will remain securely closed, even under the hydraulic head pressure applied thereto by the fluid product 18 when the container 2 is completely full.

When additional pressure is communicated with the interior of container 2, such as by manually flexing container sidewalls 14 and 15 inwardly, connector sleeve 7 functions as a rolling diaphragm, and permits valve head 5 to begin shifting axially outwardly toward the exterior of dispensing package 1 by doubling over connector sleeve 7, which then in turn, begins to extend outwardly in a rolling fashion, as illustrated in FIG. 8. The outwardly protruding J-shaped configuration of connector sleeve 7 assists in initiating this rolling motion of connector sleeve 7. The elastic deformation of connector sleeve 7 from its original molded shape (FIG. 7), generates a complex pattern of stresses within valve 3 which resiliently urges the same back into its original or normal configuration, which forces include an outwardly directed torque applied by connector sleeve 7 to valve head 5 adjacent marginal edge 42, which tends to resiliently urge discharge orifice 6 toward its open position, as described in greater detail below.

Figure 9:
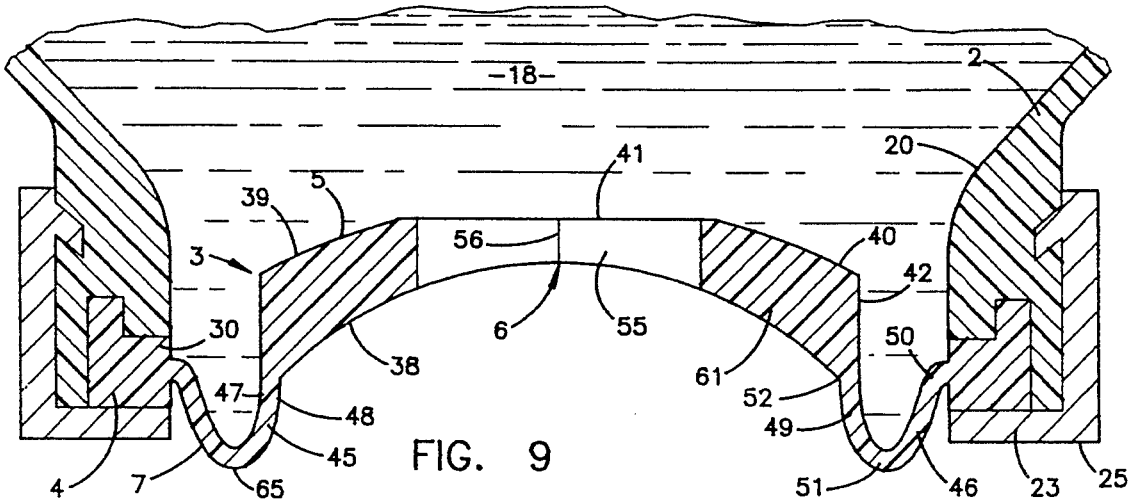
FIG. 9 is an enlarged, cross-sectional view of the valve installed in an associated container, with the valve shown in a fully closed and partially extended position.

When additional pressure is communicated with the interior of container 2, as illustrated in FIG. 9, valve head 5 continues to shift axially outwardly by rolling connector sleeve 7 over upon itself. The marginal edge 42 of valve head 5 passes through the center of marginal valve flange 4.

Figure 10:
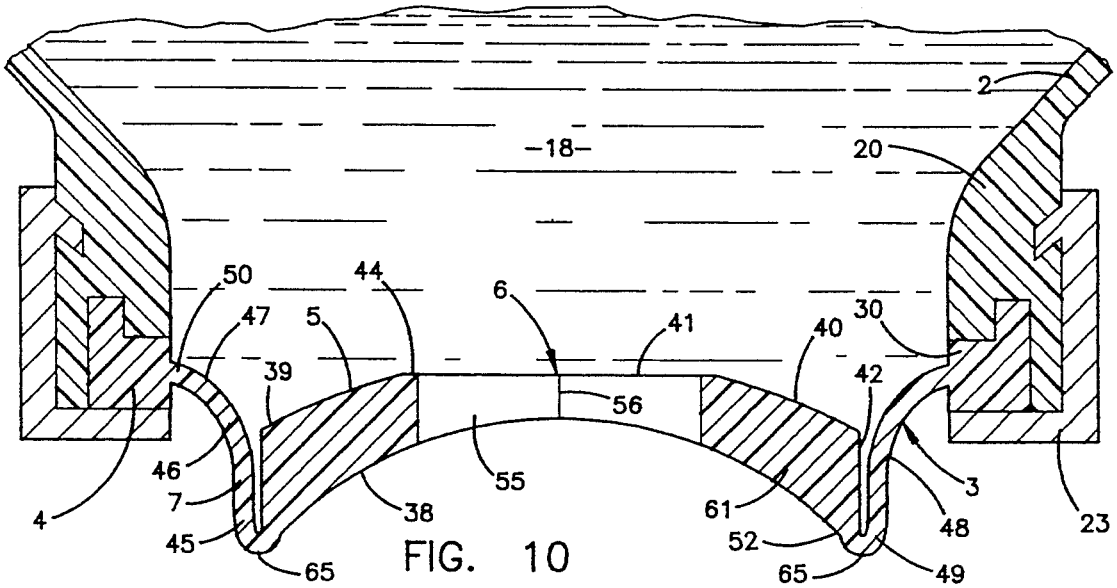
FIG. 10 is an enlarged, cross-sectional view of the valve installed in an associated container, with the valve shown in a fully closed and fully extended position.

When additional pressure is communicated with the interior of container 2, valve head 5 continues to extend outwardly toward the exterior of dispensing package 1 until connector sleeve 7 is fully extended, as illustrated in FIG. 10. When valve heads are in the fully extended position (FIG. 10), the stress forces built up in connector sleeve 7 cause the sidewall portion 45 of the connector sleeve 7 to assume a generally cylindrical shape concentric with and about the marginal edge 42 of valve head 5. Sidewall 45 of connector sleeve 7 is folded back 180 degrees from its original molded shape, to an orientation parallel with the marginal edge 42 of valve head 5, and defines an exterior lip or rim 65.

Figure 11:
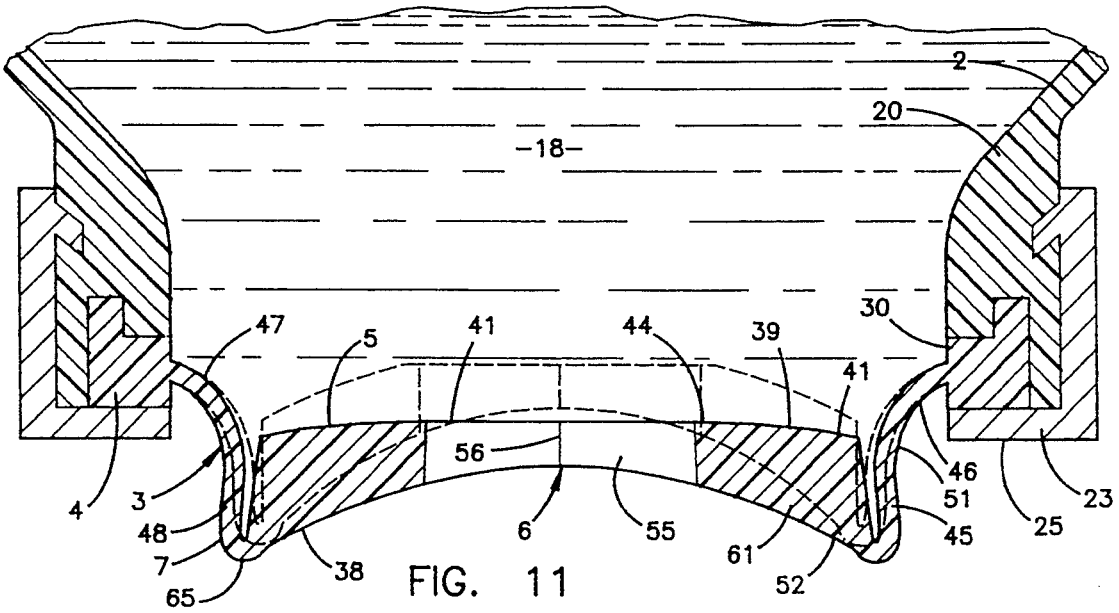
FIG. 11 is an enlarged, cross-sectional view of the valve installed in an associated container, with the valve shown in a fully closed and fully extended position, wherein a valve head portion thereof is shown beginning to snap outwardly.

When additional pressure is communicated with the interior of container 2, as illustrated in FIG. 11, valve head 5 continues to shift outwardly. However, since connector sleeve 7 is fully extended, further outward shifting of valve head 5 longitudinally tenses or stretches connector sleeve 7, thereby increasing the outwardly directed torque applied to the valve head 5. Also, the further outward movement of valve head 5 tends to flatten or straighten valve head 5, particularly along the exterior surface 38 thereof, as best illustrated in FIG. 11. This flattening motion tends to enlarge or dilate the circular plan configuration of valve head 5, which enlargement is in turn resisted by radially inwardly directed forces applied to the marginal edge 42 of valve head 5 by connector sleeve 7, thereby generating another complex pattern of stresses within valve 3, which forces include those which tend to compress valve head 5 in a radially inward direction. Due to the tapered shape of valve head 5, the majority of compression strain is believed to take place adjacent the center portion 41 of valve head 5. As best illustrated by a comparison of the broken line figure and the full line figure provided in FIG. 11, when connector sleeve 7 is in the fully extended position, as shown in the broken lines, and additional pressure is communicated with the interior side 39 of valve 3, exterior rim 65 moves axially outwardly and radially outwardly as shown in the full lines of FIG. 11. The marginal edge 42 of valve head 5 is shown bent or elastically deformed inwardly as a consequence of the torque forces applied thereto by connector sleeve 7.

Figure 12:
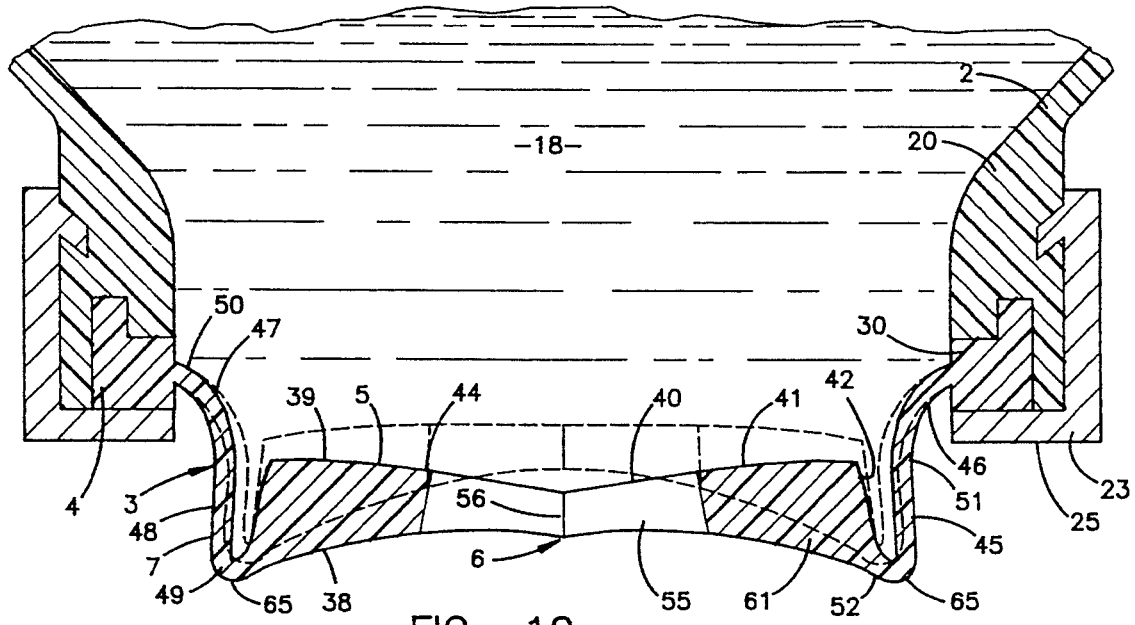
FIG. 12 is an enlarged, cross-sectional view of the valve installed in an associated container, with the valve shown in a fully closed, and fully extended position, wherein the valve head portion is shown continuing to snap outwardly.

When additional pressure is communicated with the interior of container 2, as illustrated in FIG. 12, valve head 5 continues to shift outwardly by further longitudinal stretching of connector sleeve 7, and further enlargement of the plan shape of valve head 5. This motion is best illustrated by a comparison of the broken line figure and the full line figure provided in FIG. 12. Exterior rim 65 moves from the condition illustrated in FIG. 11, which corresponds to the broken line figure of FIG. 12, in an axially outwardly and radially outwardly fashion to the position shown in the full lines of FIG. 12. The marginal edge 42 of valve head 5 is shown more bent or elastically deformed inwardly, as a consequence of the increased torque forces applied thereto by connector sleeve 7. These combined forces and motions also serve to further compress valve head 5 into a state of bifurcation, as illustrated in FIG. 12, wherein the combined forces acting on valve head 5 will, upon application of any additional outward force on the interior side 39 of valve 3, cause the same to quickly open outwardly with a snapping motion to separate valve flaps 57 in the manner illustrated in FIGS. 13 and 14, and thereby dispense liquid product through discharge orifice 6. The bifurcation state of valve 3, as the term is used herein, is illustrated in FIG. 12, and defines a relatively unstable condition which valve 3 assumes immediately prior to opening into the fully open condition shown in FIGS. 13 & 14. As valve 3 passes through the bifurcation state shown in FIG. 12, the combined forces acting on valve head 5 are in a very temporary, unstable condition of equilibrium for a given moment, and then quickly shift valve head 5 into a generally outwardly protruding shape, simultaneously opening orifice 6. In the bifurcation state shown by the full lines in FIG. 12, valve head 5 assumes the shape of a nearly planar disc, with exterior surface 38 cupped inwardly between rim 65 and flap edges 60, and interior surface 39 bent slightly outwardly toward the center of orifice 6.

The snap type opening of valve 3 is achieved, at least in part, by the torque exerted on valve head 5 by connector sleeve 7, which as noted in the example illustrated in FIG. 12, is sufficient to substantially distort the shape of the marginal edge 42 of valve head 5. When valve 3 assumes the fully extended and fully open position illustrated in FIGS. 13 & 14, valve flaps 57, as well as the associated rim portion 61 of valve head 5 are bent or elastically deformed outwardly, thereby permitting the rim 65 of valve head 5 to become smaller or constrict slightly. Valve flaps 57 tend to fold openly along lines extending between the ends 55*a* and 55*b* or orifice slits 55 and 56. The continued radial inwardly compression applied to valve head 5 by connector sleeve 7, in addition to the outwardly oriented torque applied thereto by connector sleeve 7, combine to keep discharge orifice 6 in the fully open position, even if the pressure communicated with the interior of container 2 is reduced. Hence, after discharge orifice 6 has been opened through the application of the predetermined opening pressure, that pressure which is required to maintain fluid flow through orifice 6 is reduced, or less than the threshold pressure, so as to provide greater dispensing ease and flow control. Since the resiliency of connector sleeve 7 serves to resist the dilating action of valve head 5, and thereby compresses the same to achieve a snap open/snap close motion, if the resiliency of connector sleeve 7 is varied somewhat, such as by making connector sleeve 7 thicker or thinner, the amount or degree of snap action can be thereby adjusted for any specific application. Similarly the resilient strength of ring 61 can be adjusted to accomplish the desired snap action.

Figure 13:
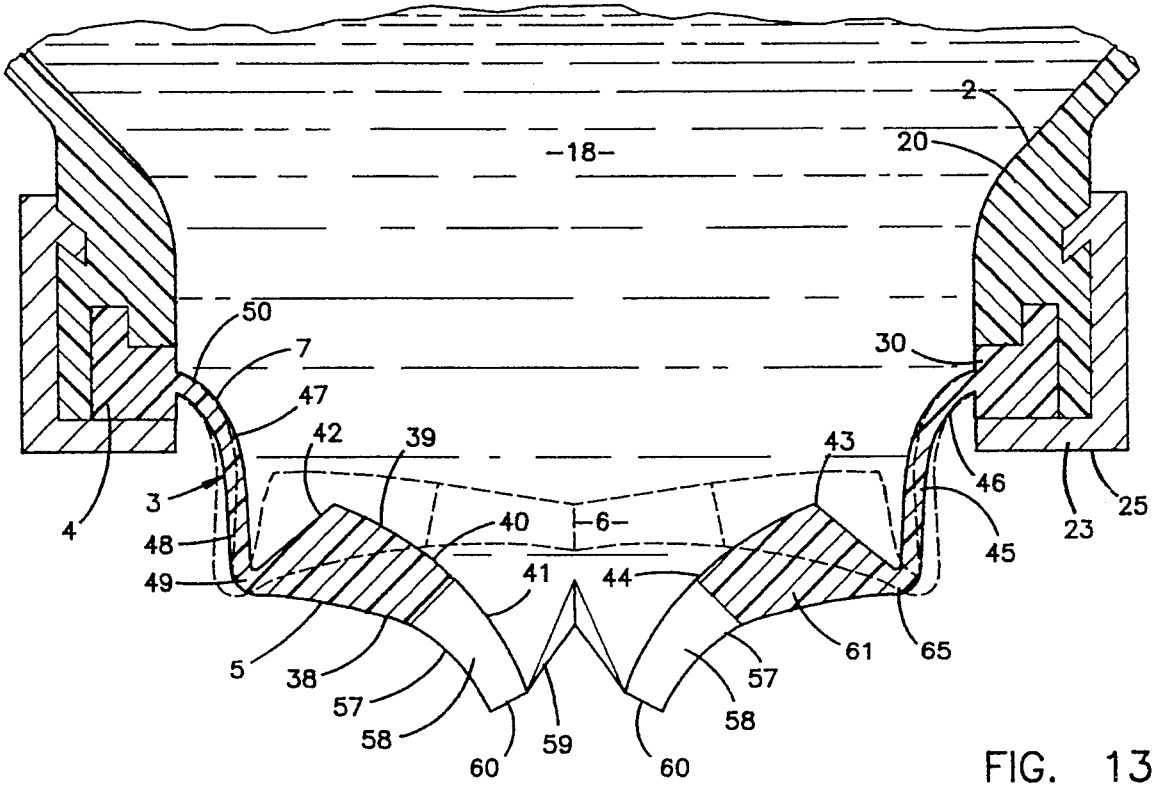
FIG. 13 is an enlarged, cross-sectional view of the valve installed in an associated container, with the valve shown in a fully extended position, wherein the valve head portion is shown snapped fully outwardly and fully open.
Figure 14:
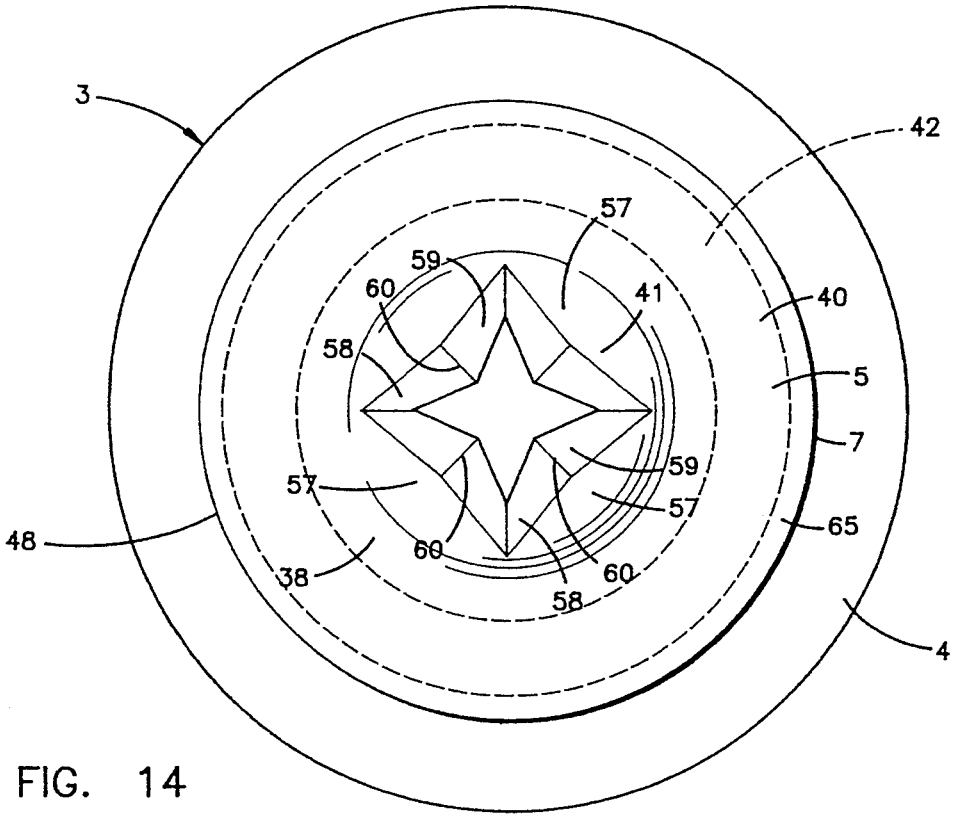
FIG. 14 is an enlarged, bottom plan view of the valve shown in the position illustrated in FIG. 13.

The combined compressive and torque forces acting on valve head 5 by connector sleeve 7 open valve flaps 57 to a generally predetermined configuration, such that the rate of flow through discharge orifice 6 remains substantially constant, even though significant pressure differences are applied to container 2. As best illustrated in FIGS. 13 and 14, after valve 3 passes through the bifurcation state shown in FIG. 12, in the direction of opening, it quickly and positively assumes the fully open condition shown in FIGS. 13 and 14, wherein the end edges 60 of valve flaps 57 diverge radially outwardly, such that discharge opening 6 assumes a star shaped plan configuration, as best seen in FIG. 14. The marginal edge 42 of valve head 5 rotates or pivots inwardly somewhat under the pressure of fluid product 18, and the resilient torque applied thereto by connector sleeve 5, which continues to resiliently urge valve 3 back toward its original molded shape (FIG. 7). Connector sleeve 7 remains tensed both axially and circumferentially under outwardly directed forces generated by the pressures within container 2, as well as the dynamic flow of fluid product through orifice 6. The geometry of the illustrated valve 3, particularly in the shape of valve head 5 and connector sleeve 7, serve to force valve 3 into the configuration shown in FIGS. 13 and 14 whenever orifice 6 is snapped opened.

When pressure within the interior of container 2 is reduced, discharge orifice 6 will still remain open in substantially the fully open position shown in FIGS. 13 & 14, until the pressure reaches the preselected closure pressure, at which point, the forces developed in connector sleeve 7 through elastic deformation from its original molded shape (FIG. 7), pull valve head 5 inwardly, back through the bifurcation state, and into the concave orientation shown in FIG. 10, thereby positively and securely closing discharge orifice 6 with a snapping action, similar to that action by which discharge orifice 6 opened. The snap closing motion of valve head 5 serves to close orifice 6 very quickly and very completely, so as to sharply cut off the stream of fluid product being dispensed from package 1 without any drops or dribbles, even when very viscous and/or dense products are being dispensed. Valve 3 will continue to assume the fully closed, fully extended position illustrated in FIG. 10, until such time as the interior pressure in container 6 is further reduced, so as to permit the resiliency in connector sleeve 7 to shift valve head 5 back into the fully retracted, initial position illustrated in FIG. 7.

At least some of those valves 3 contemplated by the present invention have a relatively high predetermined closing pressure, such as in the nature of 17–18 inches of water, so that orifice 6 will snap securely closed even if container 2 does not provide any suck back, or negative pressure. Furthermore, the connector sleeve 7 of at least some such valves 3 is constructed to provide sufficient resiliency to automatically shift valve head 5 back to the fully retracted position (FIG. 7) without any suck back or negative pressure from container 2. Hence, valves 3 can be readily adapted for use in conjunction with containers which include collapsing bags, tubes or the like. Also, valves 3 are particularly adapted for bottom dispensing packages, such as those illustrated in FIGS. 1–3, where valve 3 normally supports a column of liquid product.

In many embodiments of dispensing package 1, container 2 will be designed with relatively stiff sidewalls 14 and 15 which resume their original shape after being squeezed. In such embodiments, the suck back of air into container 2 after dispensing fluid product therefrom is typically desired to prevent collapsing the container 2, and thereby facilitate continued ease of dispensing until container 2 is completely empty. When valve 3 is in the fully closed and fully retracted position (FIG. 9), the concave configuration of valve head 5 permits orifice 6 to readily open inwardly so that air can be sucked back into the interior of container 2, yet positively prevents orifice 6 from opening outwardly in a manner which would permit leakage. Hence, even relatively weak, thin walled containers 2 can be used with valve 3 without significant collapsing of container sidewalls 14 and 15.

Figure 15:
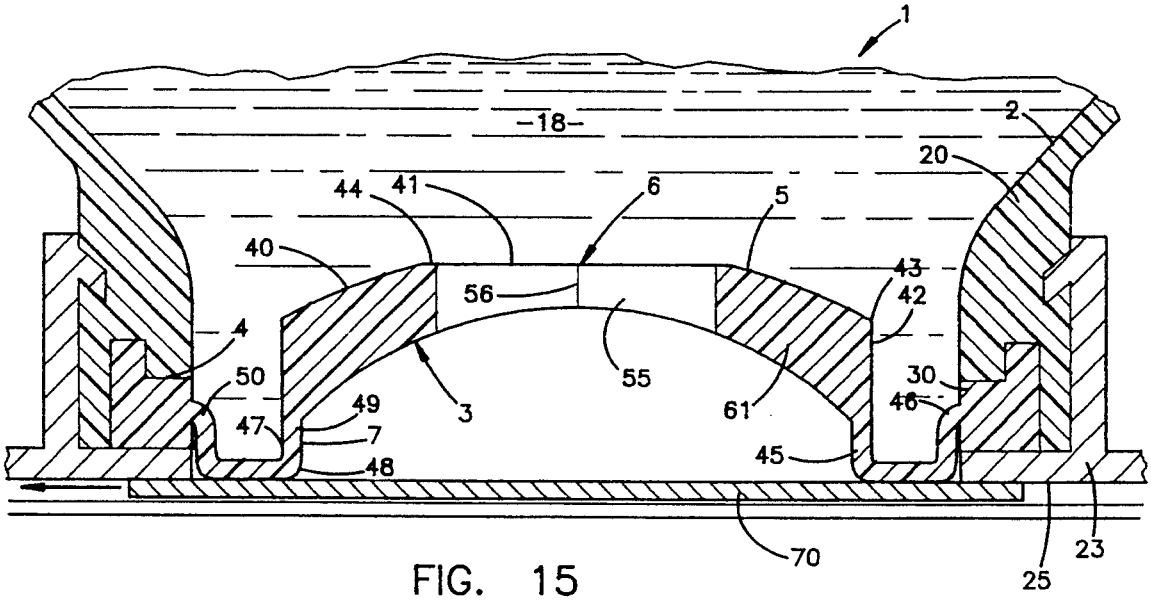
FIG. 15 is an enlarged, cross-sectional view of the valve installed in an associated container, with the valve shown in a fully closed, and partially extended position abutting a container closure.

With reference to FIG. 15, dispensing package 1 may be provided with a positive closure arrangement to prevent inadvertent discharge when dispensing package 1 is being transported, or the like, such as for initial shipping, travel, etc. The dispensing package 1 shown in FIG. 15 includes a sliding closure 70, which when closed, physically blocks the outward rolling extension of connector sleeve 7 and associated valve head 5. By constraining the outwardly extending motion of connector sleeve 7, valve head 5 is prevented from inverting into a convex configuration, and thereby keeps discharge orifice 6 fully closed. When closure 70 is slid sideways out from underneath valve 3, valve 3 is then free to reciprocate and open orifice 6 to dispense liquid product from container 2.

Figure 16:
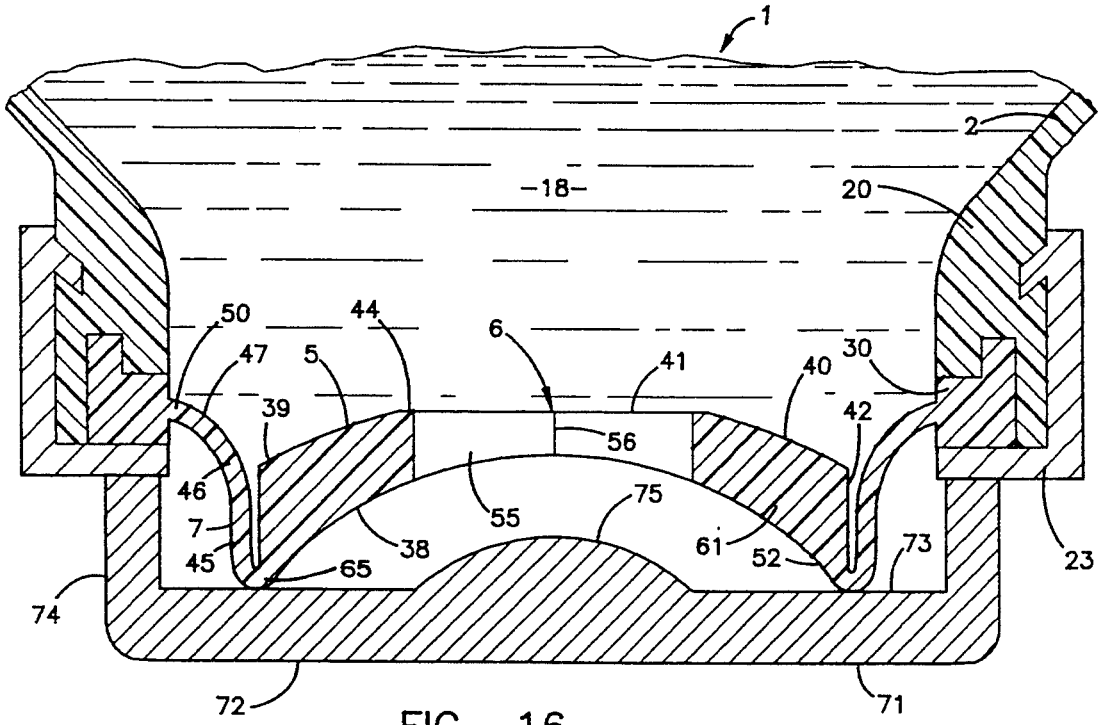
FIG. 16 is an enlarged, cross-sectional view of the valve installed in an associated container, with the valve shown in a fully closed and fully extended position abutting an alternative container closure.

FIG. 16 is a partially schematic view of an alternative closure arrangement for dispensing package 1, wherein a removable cap 71 is provided for detachable connection with retainer ring 23 by conventional fastener means, such as a snap lock, hinge, etc. (not shown). The illustrated cap 71 has a generally flat exterior surface 72, an interior surface 73, and a cylindrical side wall 74, which is sized and shaped such that interior cap surface 73 abuts the rim 65 of valve 3 when valve head 5 is in its fully extended position. The central portion of cap interior surface 73 includes an inwardly projecting protuberance 75, which in the illustrated example, is generally in the form of a convex, semi-spherical node that extends inwardly toward valve 3 to a position adjacent to the cupped exterior surface 38 of valve 3. Node 75 is shaped to positively retain valve head 5 in a concave configuration, and thereby securely maintain orifice 6 fully closed.

The reciprocating motion of valve head 5 on rolling connector sleeve 7 provides dispensing package 1 with several important advantages. For example, connector sleeve 7 is preferably configured with sufficient flexibility that abnormal pressure increases developed within the interior of container 2, such as those caused by thermal expansion, or the like, are offset by the axial shifting motion of valve head 5 with respect to connector sleeve 7, so as to alleviate excess pressure on discharge orifice 6. In this manner, if dispensing package 1 were used in conjunction with a liquid soap or shampoo that was designed for hanging in an inverted condition in a shower or bath, when ambient temperatures within the shower rise, instead of communicating the associated pressure increases directly to discharge orifice 6 in a manner which might cause it to inadvertently open, valve head 5 shifts axially outwardly to relieve any such pressure, and thereby prevent any inadvertent leakage of the fluid product from dispensing package 1.

Another example of the benefits achieved by the rolling diaphragm action of connector sleeve 7 and axial reciprocating motion of valve head 5, is that connector sleeve 7 is preferably configured with sufficient flexibility that any misalignment and/or distortion of the valve flange 4, such as that experienced when attaching the valve to container 2, are not transmitted to valve head 5, thereby permitting unhindered operation of discharge orifice 6. As previously noted, due to the inherently sticky nature of liquid silicone rubber, the attachment of valves constructed from the same to a container 2 can be quite difficult, and often results in some type of unequal compression and/or distortion of the marginal flange 4 of valve 3. Without the rolling diaphragm action of connector sleeve 7, any such distortion is communicated directly to the valve head 5, which in turn distorts discharge orifice 6, and alters important design characteristics such as its predetermined opening pressure, closing pressure, flow rate, etc. The rolling diaphragm connector sleeve 7 associated with the present valve 3 tends to insulate or isolate valve head 5 from marginal flange 7, such that it can float freely, and thereby avoid such problems.

Yet another example of the benefits achieved by this aspect of the present invention is that connector sleeve 7 is preferably configured with sufficient flexibility that vibrations, shock impact forces, and the like applied to container 2 are absorbed and/or dampened by shifting valve head 5 on rolling connector sleeve 7, so as to avoid inadvertent opening of discharge opening 6. In the event dispensing package 1 is dropped onto the floor, slammed forcefully against a worksurface, or otherwise jarred or shook, the shock forces arising from the acceleration and/or deceleration of the fluid product within container 2 would otherwise be communicated directly with the discharge orifice 6, and tend to cause it to open inadvertently. However, the rolling connector sleeve 7 action of valve 3 serves as a cushion or shock absorber for such shock impact forces, and thereby greatly alleviates the chance for the inadvertent discharge of fluid product from dispensing package 1. In a similar manner, when dispensing container 1 is used for non-homogenous fluids, such as some types of salad dressings, or the like, which are typically shook prior to use, connector sleeve 7 assists in absorbing these vibrations, and thereby prevent leakage.

Yet another example of the benefits achieved by this aspect of the present invention is that connector sleeve 7 is preferably configured with sufficient flexibility that only very moderate pressures, substantially lower than the predetermined opening pressure of valve 3, are required to shift valve head 5 from the fully retracted position (FIG. 7) to the fully extended position (FIG. 10), thereby improving the dispensing "feel" of the package 1. When the user grasps container 2, even a very light squeeze on sidewalls 14 and 15 will rollingly extend connector sleeve 7 and valve head 5 to the fully extended and fully closed position shown in FIG. 10, at which point valve head 5 halts momentarily and further movement of the fluid product is resisted until additional forces are exerted on container 2 which result in an internal pressure within container 2 greater than the predetermined opening pressure of valve 3. This motion of connector sleeve 7 and valve head 5 is sensed by the user through touch or feel, typically in the form of a vibration or ripple experienced in container sidewalls 14 and 15 when valve head 5 reaches the fully extended position (FIG. 10). This ripple motion signals the user that valve head 5 is fully extended, and that further pressure will cause valve 3 to snap open and dispense fluid product. When valve 3 snaps open and snaps closed, similar vibrations or ripples are communicated to the user through container sidewalls 14 and 15 to assist in achieving accurate flow control.

In the illustrated examples of dispensing package 1, valve 3 is mounted within container 2 in a manner which causes valve head 5 to shift between the fully retracted position shown in FIG. 7 wherein valve 3 is disposed wholly within the interior of container 2 for safely storing valve 3, and the fully extended discharge position shown in FIGS. 13 & 14 wherein valve head 5 and associated orifice 6 are disposed wholly outside container 2 for neatly dispensing the fluid product therethrough. By shifting valve head 5 between these two extreme positions, valve 3 can remain normally unexposed and secure within the container 2 when not in use, without sacrificing neatness when dispensing. Also, valve 3 is preferably positioned in container 2 so that the arcuate portion 51 of connector sleeve 7 is disposed adjacent the bottom 25 of container base 13, so that if dispensing package is slammed down onto a surface, abutment between valve 3 and the surface will prevent valve 3 from shifting to the fully extended position, and thereby keep orifice 6 closed to prevent inadvertent leakage.

Dispensing package 1 is extremely versatile, being capable of easily and neatly dispensing a wide variety of fluid products. The self-sealing valve 3 is matched with both the container 2 and the type of liquid product 18 to be dispensed therefrom, so as to quickly and securely seal, yet readily open upon manipulation by the user, without requiring excess pressure or forces. The resiliently flexible connector sleeve 7, which is configured to double over and extend rollingly, accommodates for thermal expansion within container 2, absorbs shock impact forces to the container, accommodates for any misalignment and/or distortion which might be applied to the valve flange in attaching the same to the container, and provides a unique dispensing feel which greatly facilitates accurate dispensing. Valve 3 is configured so that when orifice 6 snaps open, a generally constant flow rate is established therethrough, even when container 2 is subjected to a relatively wide range of pressures. Valve 3 is also preferably configured such that once discharge orifice 6 is open, the amount of pressure required to maintain fluid flow is reduced, so as to provide greater ease of operation and control, without sacrificing secure sealing. Dispensing package 1 is particularly adapted for bottom dispensing configurations, shake containers, and other similar packaging concepts, without leakage.

Figure 17:
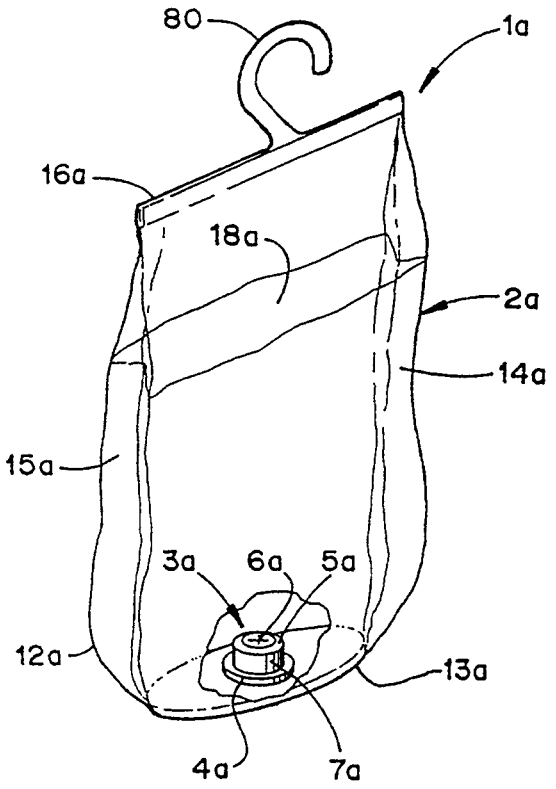
FIG. 17 is a perspective view of another embodiment of the present dispensing package, wherein a portion thereof has been broken away to reveal a self-sealing valve mounted in a bottom portion of a collapsible wall container.

The references numeral la (FIG. 17) generally designates another dispensing package embodying the present invention, wherein one of the previously described dispensing valves is mounted in a collapsible bag type of container. Since dispensing package la is similar to the previously described dispensing package 1, similar parts appearing in FIGS. 1–16 and FIG. 17 respectively are represented by the same, corresponding reference numeral, except for the suffix "a" in the numerals of the latter. In dispensing package 1*a*, container 2*a* is particularly designed for bottom dispensing, and includes a collapsible container body 12*a* having a rigid base 13*a* in which valve 3*a* is mounted. Container body 12*a* is preferably integrally formed from a section of flexible film or the like, in the nature of a bag, and includes collapsible sidewalls 14*a* and 15*a*. The container sidewalls 14*a* and 15*a* are sufficiently flexible that they readily collapse inwardly toward one another when fluid product 18*a* is dispensed from container 2*a*. In the illustrated example, a hook-shaped hanger 80 is provided adjacent the top 16*a* of container body 12*a* at a medial portion thereof, and serves to detachably hang container 2*a* in a suspended orientation from an associated support (not shown).

The self-sealing dispensing valve 3*a* mounted in container 2*a* is identical to the previously described dispensing valve 3, and includes a marginal flange 4*a*, a valve head 5*a* with a discharge orifice 6*a* therein, and a connector sleeve 7*a*, having one end area thereof connected with valve flange 4*a*, and the opposite end area thereof connected with valve head 5*a* adjacent a marginal portion thereof.

In general, dispensing valve 3*a* operates the same as dispensing valve 3, as illustrated in FIGS. 7–14, and described in the related specification. However, when fluid product 18*a* is dispensed from dispensing package 1*a*, the walls 14*a* and 15*a* of container 2*a* simply collapse, and do not shift back into their original shape, as experienced with previously described container 2. In dispensing package 1*a*, the resilient flexibility of connector sleeve 7*a* applies an outwardly directed torque or leverage to the valve head 5*a* when pressure within container 2*a* is raised above the predetermined discharge pressure, so as to assist in opening orifice 6*a*. The connector sleeve 7*a* of valve 3*a* also applies an inwardly directed torque or leverage to valve head 5*a* when the predetermined discharge pressure within container 2*a* is released, so as to assist in closing orifice 6*a*. The closing torque generated within dispensing valve 3*a* is sufficient to positively shift valve 3*a* into its fully closed position, without requiring any negative pressure or suck back within the interior of container 2*a*, thereby permitting the use of valve 3*a* with a collapsible bag type of container 2*a*. When the hydraulic head acting on valve 3*a* falls below a preselected amount, valve 3*a* will further shift into its fully retracted position. Hence, the same self-sealing dispensing valve 3 and 3*a* can be effectively used with either the bag type collapsible wall container 2*a* illustrated in FIG. 17, or the squeeze type resilient wall container 2 illustrated in FIG. 1.

Figure 18:
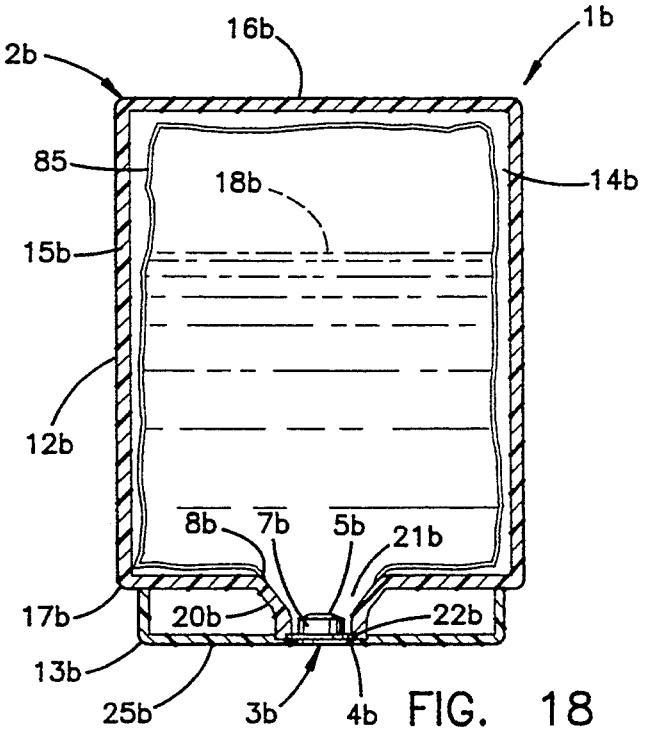
FIG. 18 is a vertical cross-sectional view of yet another dispensing package embodying the present invention, wherein a self-sealing valve is mounted in a bottom portion of a squeeze type container having an interior collapsible bag liner.

The reference numeral 1*b* (FIG. 18) generally designates yet another dispensing package embodying the present invention, wherein one of the previously described dispensing valves is mounted in a squeeze type resilient wall container having a collapsible liner mounted on the interior thereof. Since dispensing package 1*b* is similar to the previously described dispensing packages 1 and 1*a*, similar parts appearing in FIGS. 1–17 and FIG. 18 respectively are represented by the same, corresponding reference numeral, except for the suffix "b" in the numerals of the latter. Dispensing package 1*b* includes a multi-part container 2*b*, having a self-sealing valve 3*b* mounted therein which is identical to the previously described dispensing valves 3 and 3*a*. Container 2*b* is also particularly designed for bottom dispensing, and includes a general flexible, oblong container body 12*b* supported on a substantially rigid base 13*b*. Container body 12*b* is preferably integrally molded from an appropriate synthetic material or the like, so as to create a one-piece construction that includes oppositely oriented sidewalls 14*b* and 15*b*, a top 16*b* and a bottom 17*b*. The container sidewalls 14*b* and 15*b* are laterally flexible, and preferably have sufficient resilience or stiffness that they automatically return to their original shape upon release of any external forces which are applied to container 2*b* to dispense fluid product 18*b* therefrom. A collapsible bag liner 85 is mounted within the interior of container body 12*b*, and is preferably constructed from a thin sheet or film type of material or the like, which is sealed about its marginal edges to retain the fluid product 18*b* therein without leaking. The walls of bag liner 85 are sufficiently flexible that they readily converge together or collapse when fluid product 18*b* is dispensed therefrom. Flexible bag liner 85 has an open end 86 which is sealingly connected with downwardly opening neck 20*b* of container body 12*b* at discharge opening 21b. It is to be understood that collapsible bag liner 85 may also be detachably connected with container body 12b, so as to be replaceable. When container sidewalls 14b and 15b are squeezed or converged, pressure is thereby applied to collapsible bag liner 85, which pressure is in turn applied to the fluid product 18b therein, so as to dispense product through valve 3b. A small vent aperture, check valve arrangement, or other similar arrangement (not shown) may be incorporated into container 2b to permit ambient air to be drawn back into container 2b after dispensing, so that resilient sidewalls 14b and 15b return to their original shape. The walls of bag liner 85 may be made thicker at their base area and thinner at their top area to facilitate collapsing bag liner 85 from top to bottom without folds or other obstructions that might inhibit the dispensing of all product from container 2b.

Valve 3b is mounted in dispensing package 1b in a fashion substantially similar to the arrangement illustrated in FIGS. 1-3, wherein an annularly shaped groove 22b is provided at the free end of neck 20b, and is shaped to closely receive the marginal flange 4b of valve 3b therein. A valve retainer ring (not shown) is positioned adjacent groove 22b, and is attached to container body 12b by a snap-lock arrangement. Container base 13b has a substantially flat bottom portion 25b that is adapted to abuttingly support dispensing package 1b on an associated surface, such as a countertop, sink, worksurface, or the like.

In general, dispensing valve 3b operates in the same manner as dispensing valve 3, as illustrated in FIGS. 7-14, and described in the related specification. However, dispensing package 1b operates in a manner quite similar to above described dispensing package 1a (FIG. 17), wherein as fluid product 18b is dispensed therefrom, the walls of collapsible bag liner 85 simply converge together, such that there is no suck back of air into the bag liner. Valve 3b is configured such that it will positively return to its fully closed position by simply removing the predetermined discharge pressure, without requiring a negative pressure to be developed within the interior of the collapsible bag liner 85.

In those embodiments of the present invention wherein the container does not apply a negative pressure to the dispensing valve, such as dispensing package 1a and 1b, the use of a single slit orifice in the dispensing valve will assist in preventing air from being sucked back into the container. In those applications where the product deteriorates when exposed to air, the extra suck back resistance provided by a single slit valve orifice may be beneficial.

Figure 19:
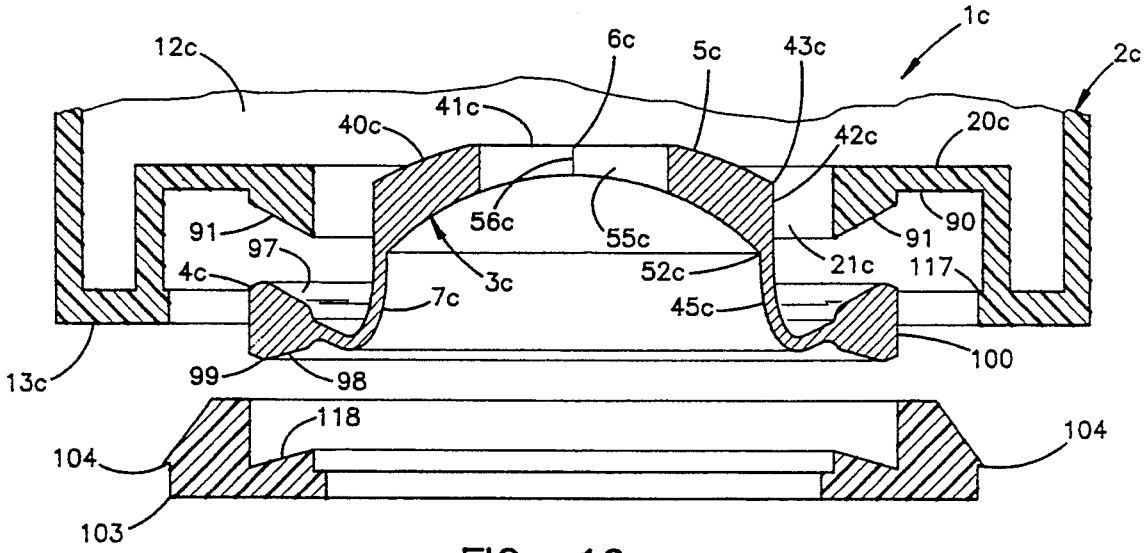
FIG. 19 is an enlarged, fragmentary, vertical cross-sectional view of another dispensing package embodying the present invention, shown in a disassembled condition, and including a valve with an asymmetrically configured flange.
Figure 20:
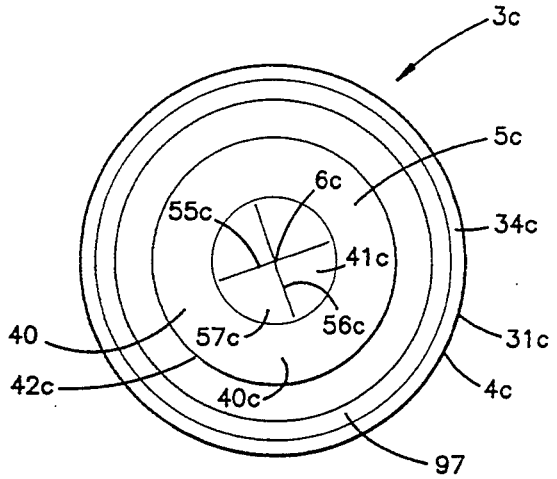
FIG. 20 is a top plan view of the valve shown in FIG. 19.

The reference numeral 1c (FIGS. 19-25) generally designates yet another dispensing package embodying the present invention, which includes a dispensing valve having a unique flange configuration. Since dispensing package 1c is similar to the previously described dispensing packages 1-1b, similar parts appearing in FIGS. 1-18 and FIGS. 19-25 respectively are represented by the same, corresponding reference numeral, except for the suffix "c" in the numerals of the latter. In the example illustrated in FIG. 19, dispensing package 1c includes a container 2c having a squeeze type body 12c, and a substantially rigid base 13c, with a neck 20c that defines a discharge opening 21c about which the marginal flange 4c of valve 3c is positioned. Container neck 20c includes adjacent its free end a recessed portion 90 with a beveled valve seat 91 positioned about discharge opening 21c. Beveled valve seat 91 is inclined upwardly in a radially outwardly extending direction, and is adapted to mate with the marginal flange portion 4c of valve 3c in the manner described in further detail hereinbelow.

Valve 3c is substantially identical in construction to previously described valves 3-3b, except valve 3c has a uniquely shaped marginal flange portion 4c. Like valves 3-3b, valve 3c also includes a valve head 5c with a discharge orifice 6c therein, and a connector sleeve 7c, having one end area thereof connected with valve flange 4c, and the opposite end area thereof connected with valve head portion 5c adjacent a marginal portion thereof. Connector sleeve 7c has a resiliently flexible construction, such that when pressure within container 2c is raised above a predetermined amount, valve head 5c shifts outwardly in a manner which causes connector sleeve 7c to double over and then extend rollingly. The marginal edge 42c of valve head 5c is tapered slightly inwardly toward the central axial axis of valve 3c by an amount in the nature of 1-3 degrees, which facilitates molding operations.

The unique construction of valve flange 4c facilitates conveying a plurality of like valves 3c, such as to an assembly station for connection with an associated container 2c, which may be accomplished with associated machinery (not shown). Although the present invention contemplates use in conjunction with a wide variety of different types of conveying mechanisms, in the embodiment illustrated in FIGS. 23-25, a vibrating chute 93 is provided, which has a generally U-shaped transverse cross-sectional configuration, comprising a base 94, and opposite upstanding sidewalls 95. Vibrating chute 93 is inclined slightly, and includes a powered mechanism or motor (not shown) for imparting vibratory motion thereto, so as to cause valves 3c to translate smoothly along chute 93, as described below.

The marginal flange portion 4c of valve 3c is especially designed for conveyance along chute 93, and includes a first surface 97 (FIG. 19) oriented to face generally toward valve head 5c, and a second surface 98 oriented to face generally away from valve head 5c. The first flange surface 97 is shaped for sealing abutment with beveled valve seat 91, and the second flange surface 98 has a support edge area 99 which projects outwardly in a direction away from valve head 5c to a location exteriormost of valve 3c. The support edge area 99 of valve flange 4c is configured to abut the interior surface 96 of the base 94 of vibrating chute 93 when valve 3c is positioned thereon in a predetermined upright orientation, with valve head 5c oriented upwardly. During handling of valve 3c, such as for assembly in an associated container 2c, a plurality of valves 3c are preferably positioned on the conveying surface 96 of chute 93 in their upright orientation, such that the support edge area 99 of each valve 3c is in abutment with conveyor surface 94, which establishes minimum contact therebetween to facilitate reliably translating valves 3c along the chute 93, while retaining the valves 3c in their predetermined upright orientation.

Figure 21:
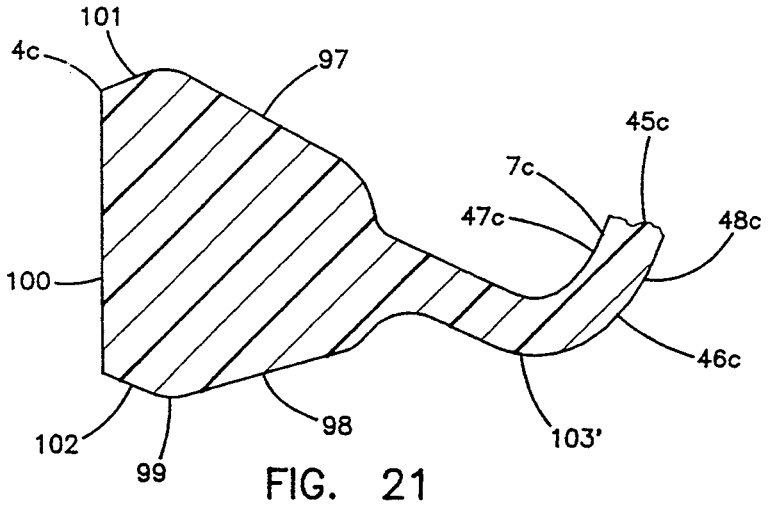
FIG. 21 is an enlarged, vertical cross-sectional view of a flange portion of the valve shown in FIGS. 19–20.

As best shown in FIG. 21, the flange portion 4c of valve 3c has a curved or arcuate support edge area 99, which is oriented to project outwardly away from valve head 5c in a convex fashion, so as to alleviate binding and sticking on conveying surface 96. The illustrated valve flange 4c also includes a generally flat outer edge 100 which extends between the outer portions of flange surfaces 97 and 98. The flat outer edge 100 of valve flange 4c is oriented generally parallel with the central axial axis of valve 4c, and assists in routing valve 3c along conveying surface 96 in its upright orientation, as described below. The major portions of valve flange surfaces 97 and 98 are substantially flat, and taper inwardly toward connector sleeve 7c. The outermost portions 101 and 102 of flange surfaces 97 and 98 taper in an opposite direction. The first and second valve flange surfaces 97 and 98 are arranged in a mutually asymmetrical configuration, wherein flange surface 97 is oriented at an angle with respect to the central axial axis of the valve 3c that is less than the angle at which flange surface 98 is oriented with respect to the central axial axis of valve 3c. In other words, as valve flange 4c is oriented in FIG. 21, the angle of flange surface 97, as measured from surface 97 upwardly to the valve central axis, is substantially steeper than the angle of flange surface 98, as measured from surface 98 downwardly to the valve central axis. In the illustrated valve 3c, flange surface 97 is oriented at an angle of approximately 55–65 degrees with respect to flange edge 100, while flange surface 98 is oriented at an angle of approximately 70–80 degrees with respect to flange edge 100. This asymmetrical configuration also facilitates efficiently molding valves 3c.

Figure 23:
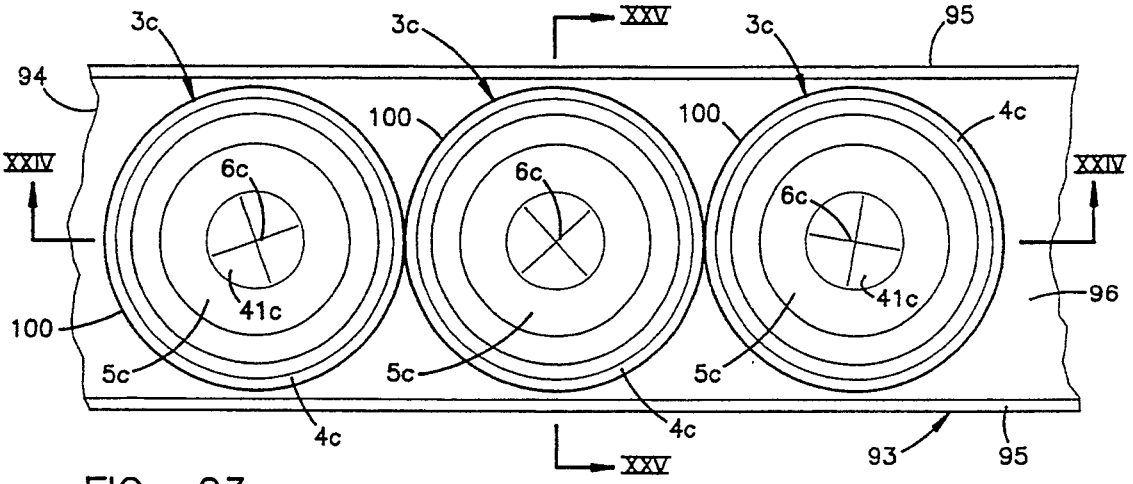
Figure 24:
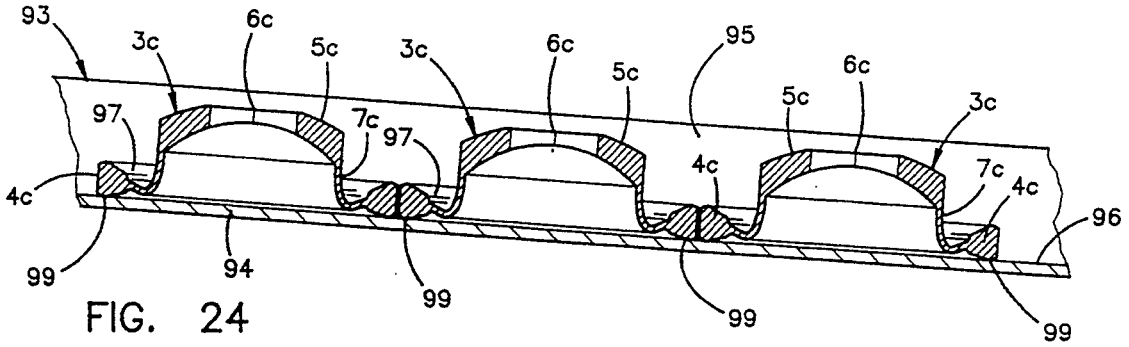
FIG. 24 is a vertical cross-sectional view of the valves and conveyor shown in FIG. 23, taken along the line XXIV—XXIV, FIG. 23.
Figure 25:
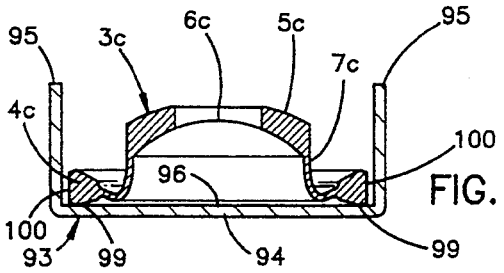
FIG. 25 is a vertical cross-sectional view of the valves and conveyor shown in FIG. 23, taken along the line XXV—XXV, FIG. 23.

The configuration of the connector sleeve 7c associated with valve 3c is substantially similar to that described above with respect to valves 3–3b, and includes a generally J-shaped sidewall 45c having a radially outwardly extending base portion 46c with interior and exterior surfaces 47c and 48c respectively. In the orientation illustrated in FIG. 21, the outwardlymost or downwardlymost protruding portion of sleeve base portion 46c is designated by the reference numeral 103', and is spaced axially inwardly or upwardly from the support edge area 99 of valve flange 4c, so that when a valve 3c is positioned on conveying surface 96 in an upright orientation, as illustrated in FIGS. 23–25, the only portion of the valve 3c which comes in contact with the conveying surface 96 is line contact by flange area 99.

When handling valves 3c, such as when assembling the same in a closure or an associated container 2c, a plurality of valves 3c may be placed in a bin or hopper (not shown), and then translated to an assembly station (not shown) by vibrating chute 93. As best illustrated in FIGS. 23–25, the width of vibrating chute 93 is preferably selected so that at least one portion thereof is just slightly greater than the diameter of valve flanges 4c, so that valves 3c are forced into a single file arrangement to facilitate automated assembly. As previously noted, the configuration of valve flange 4c is such that only the support edge area 99 of each valve 3c comes in contact with chute conveying surface 96, so as to alleviate sticking and binding thereon. The flat outer edges 100 of valves 3c are such that when they come into contact with the sidewalls 95 of vibrating chute 93, the valves 3c will not be displaced or upended from their desired, upright orientation.

Figure 22:
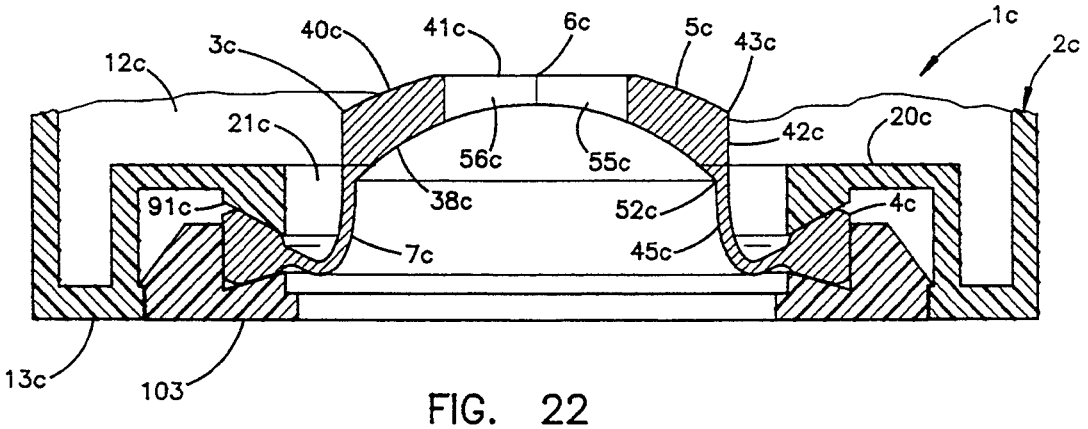
FIG. 22 is an enlarged, fragmentary, vertical, cross-sectional view of the dispensing package shown in FIG. 19, shown in an assembled condition.

The illustrated valve 3c is retained in valve seat 91 (FIG. 19) by a snap ring 103, which includes an outwardly projecting ring 104 that engages a mating lip 117 on container 2c, as shown in FIG. 22. Snap ring 103 includes a beveled seat 118 which abuts surface 98 of valve flange 4c to sealingly retain valve 3c about discharge opening 21c. In general, dispensing valve 3c operates in the same manner as dispensing valve 3, as illustrated in FIGS. 7–14, and described in the related specification. It is to be understood that dispensing valve 3c may be retained in container 2c in a variety of other fashions such as screw retainers, crimped collars, molded integrally into container 2c, and the like, and that valve seat surfaces 91 and 118 may assume many different shapes and sizes as required for a particular application.

Figure 26:
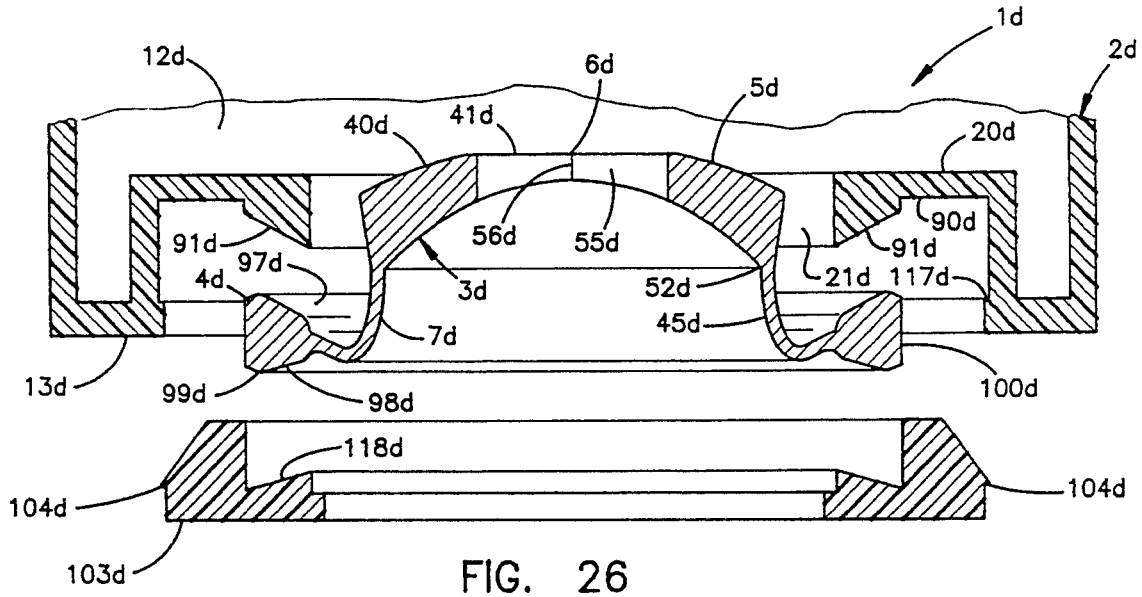
FIG. 26 is an enlarged, fragmentary vertical cross-sectional view of yet another dispensing package embodying the present invention, shown in a disassembled condition, and including a valve with a crown shaped valve head.
Figure 28:
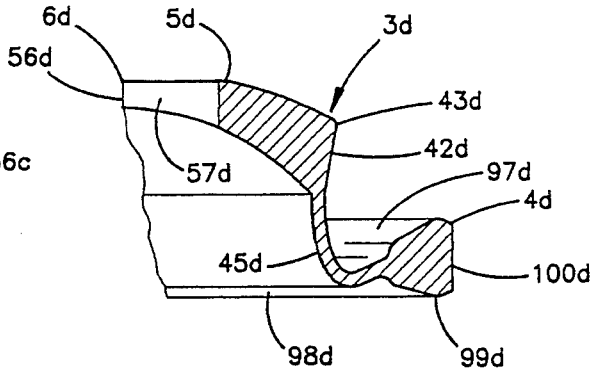
FIG. 28 is an enlarged, fragmentary, vertical cross-sectional view of a right hand portion of the crown shaped valve illustrated in FIG. 26.
Figure 29:
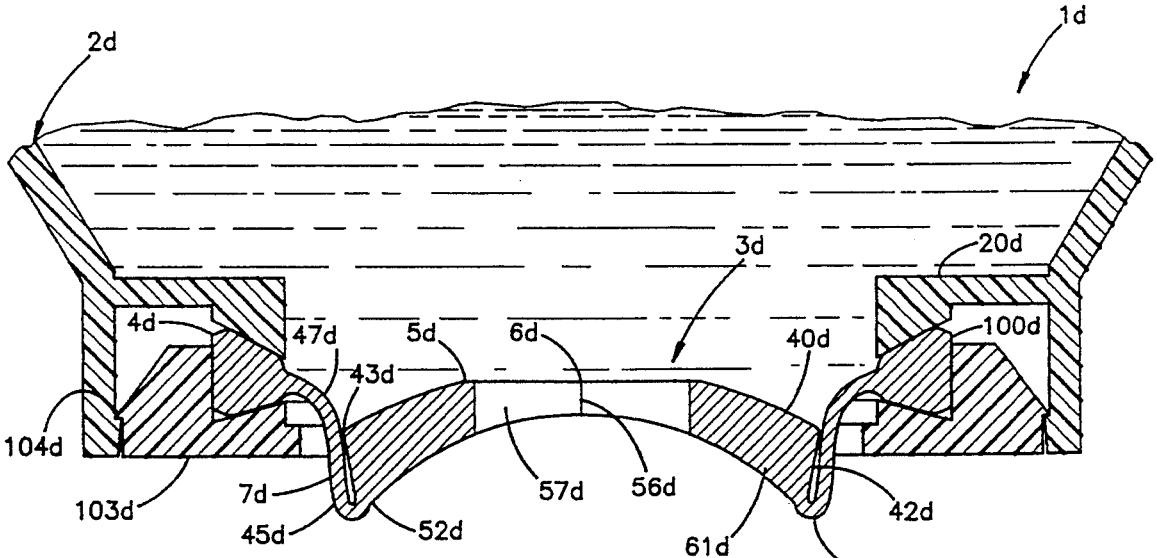
FIG. 29 is an enlarged, cross-sectional view of the crown shaped valve shown in FIGS. 26 and 28 installed in an associated container, with the valve shown in a fully closed, and fully extended position.

The reference number 1d (FIGS. 26 & 28–31) generally designates yet another dispensing package embodying the present invention, wherein the dispensing valve has a crown shaped valve head. Since dispensing package 1d is similar to the previously described dispensing packages 1–1c, similar parts appearing in FIGS. 1–25 & 27 and FIGS. 26 & 28–31 respectively are represented by the same, corresponding reference numeral, except for the suffix "d" in the numerals of the latter. In the example illustrated in FIGS. 26 & 29–31, dispensing package 1d includes a container 2d having a squeeze type body 12d and a substantially rigid base 13d, with a neck 20d that defines a discharge opening 21d about which the marginal flange 4d of valve 3d is positioned. Container neck 20d includes adjacent its free end a recessed portion 90d with a beveled valve seat 91d positioned about discharge opening 21d. Beveled valve seat 91d is inclined upwardly in a radially outwardly extending direction, and is adapted to mate with the marginal flange portion 4c of valve 3c in the manner described in further detail hereinbelow. The illustrated valve 3d is retained in valve seat 91d (FIG. 26) by a snap ring 103, which includes an outwardly projecting ring 104d that engages a mating lip 117d on container 2d, as shown in FIG. 29. Snap ring 103d includes a beveled seat 118d which abuts surface 98d of valve flange 4d to sealingly retain valve 3d about discharge opening 21d.

Figure 27:
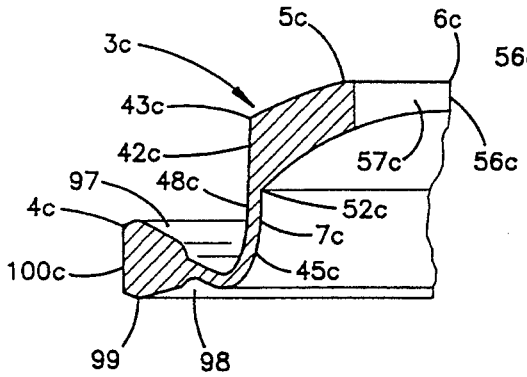
FIG. 27 is an enlarged, fragmentary, vertical cross-sectional view of a left hand portion of the valve illustrated in FIGS. 19–25.

Dispensing valve 3d (FIGS. 26–29) is substantially similar to previously described valve 3c, except for the unique crown design of valve head portion 5d. The valve head portion 5d of valve 3d has an outwardly flared or "crown" shape, which serves to alleviate nesting during handling of valves 3d, such as during assembly in an associated container 2d, and improves air suck back into the associated container 2d, without sacrificing desirable closing characteristics, as described in greater detail hereinafter. FIGS. 27 and 28 provide a side-by-side comparison between the previously described dispensing valve 3c (FIG. 27), and the crown valve 3d (FIG. 28). In dispensing valve 3c (FIG. 27), the marginal edge 42c of valve head 5c tapers radially inwardly from the central axial axis of valve 3c by an amount of the nature of 1–3 degrees. Hence, the marginal edge 42c of valve head 5c is generally in line with the exterior surface 48c of connector sleeve 7c, such that the combined structure is somewhat frustroconical in side elevation. In contrast, in the crown shaped valve 3d, as illustrated in FIG. 28, the marginal edge 42d of valve head 5d tapers or flares radially outwardly, such that it assumes an angle of around 8–12 degrees with respect to the central axial axis of valve 3d. Also illustrated in FIGS. 27 and 28, is the fact that the thickness of valve head 5c at orifice 6c is slightly greater than the thickness of valve head 5d at orifice 6d. The thinner valve head thickness associated with valve 3d improves the suck back of air into the container after dispensing, as illustrated in FIG. 1, since the flaps or petals 57d of valve head 5d are somewhat more flexible than the petals 57c of valve 3c. The crown shape of valve head 5d also provides additional torque or leverage in shifting discharge orifice 6d between the fully open and fully closed positions, so as to insure positive dispensing action, even though the thickness of valve head 5d is slightly thinner at discharge orifice 6d than in valve 3c. Hence, the desirable opening and closing characteristics of valves 3–3c is incorporated into valve 3d. Furthermore, the outwardly tapered or crown configuration of valve head 5d assists in preventing adjacent valves 3d from nesting within one another during handling of the valves 3d. The increased diameter of valve head 5d at its outmost edge 43d assists in preventing adjacent valves from becoming entangled or nested within one another during processing, thereby greatly facilitating the assembly of valves 3d in an associated container 2d, and other similar automated operations.

Figure 30:
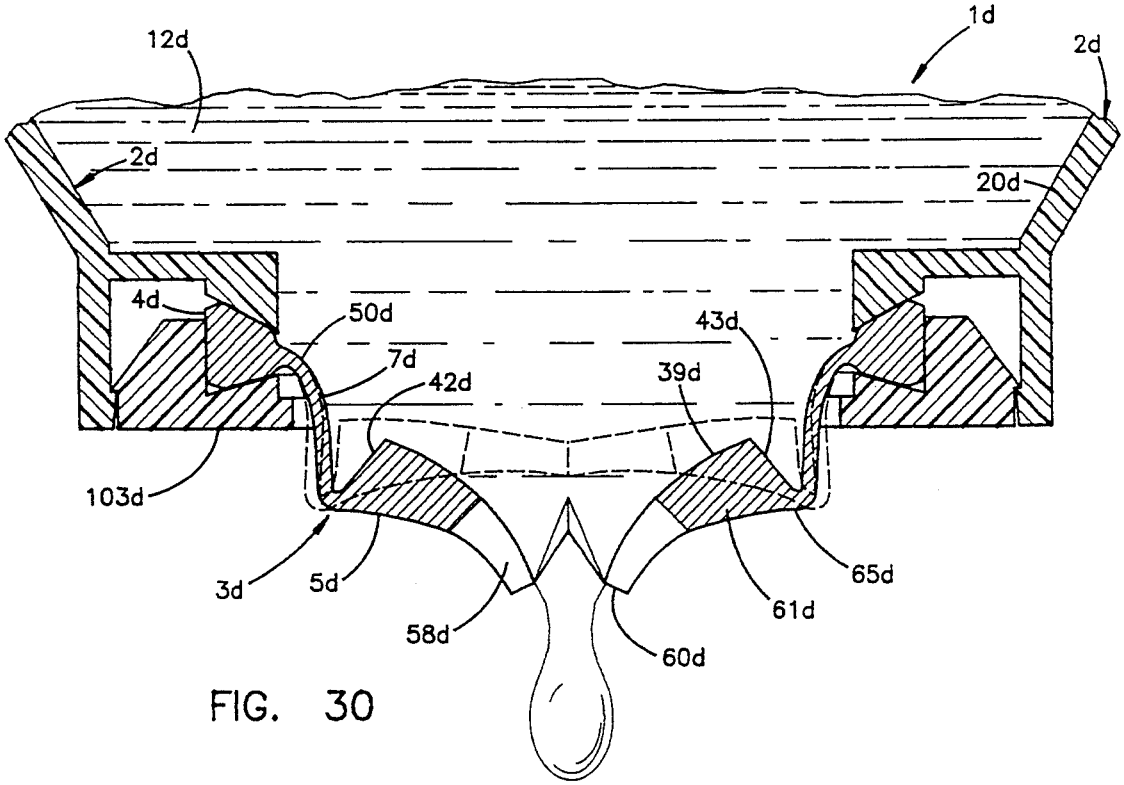
FIG. 30 is an enlarged, cross-sectional view of the crown shaped valve shown in FIGS. 26 and 28–29 installed in an associated container, with the valve shown in a fully extended position, wherein the valve head portion is shown snapped fully outwardly and fully open.
Figure 31:
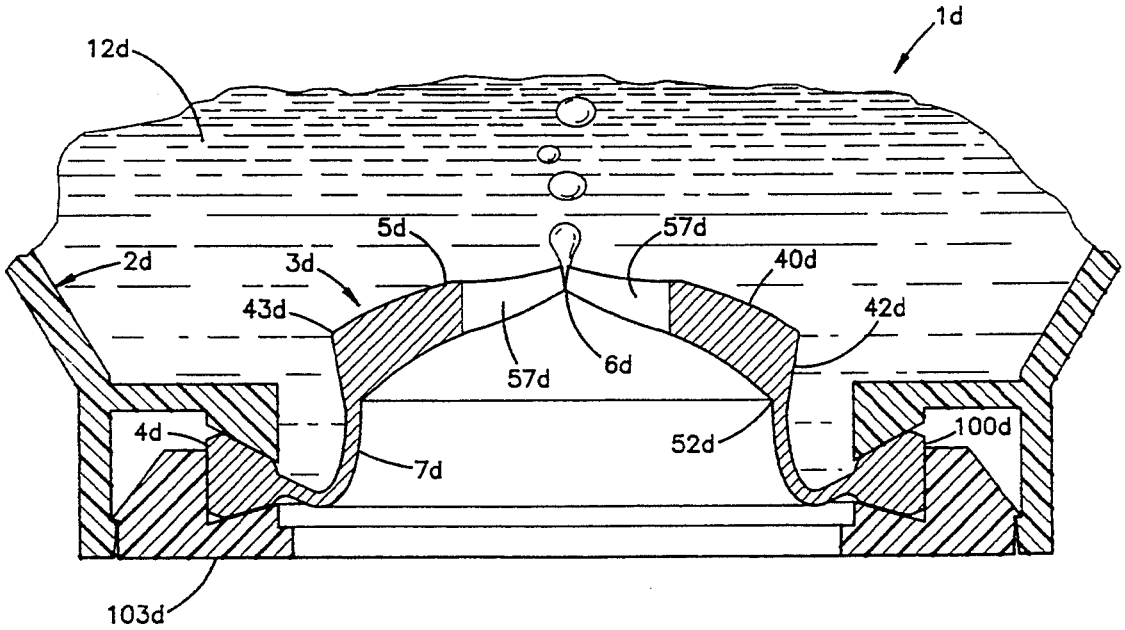
FIG. 31 is an enlarged, cross-sectional view of the crown shaped valve shown in FIGS. 26 and 28–30, installed in an associated container, with the valve shown in a fully retracted position, sucking air back into the container.

With reference to FIGS. 29–31 dispensing valve 3d operates in a manner substantially similar to that described above with respect to valve 3, except as noted below. When dispensing valve 3d is in the fully closed and fully extended position illustrated in FIG. 29, the crown shape of valve head 5d causes the outermost edge portion 43d thereof to be positioned relatively close to the interior surface 47d of connector sleeve 7d. As dispensing valve 3d is shifted into the fully open position illustrated in FIG. 30, the increased thickness accorded by the crown shape of valve head 5d provides additional torque or leverage to shift discharge orifice 6d into the fully open position. The additional thickness of crown valve head 5 also serves to provide additional torque or leverage in returning discharge orifice 6d to the fully closed position, even when valve 3d is attached to a container which does not experience a negative pressure therein, such as collapsible bag containers 2a and 2b, or other similar arrangements. When dispensing valve 3d is used in conjunction with a squeeze type resilient wall container 3d, such as the container 2 illustrated in FIGS. 1–3, or the container 2d shown in FIGS. 26 & 29–31, the crown construction of valve head 5d provides for increased suck back of air into container 2d, as illustrated in FIG. 31. This increased ability to more easily suck back air into container 2d prevents the sidewalls of the container 2d from collapsing, even when valve 3d is configured for bottom dispensing.

Figure 32:
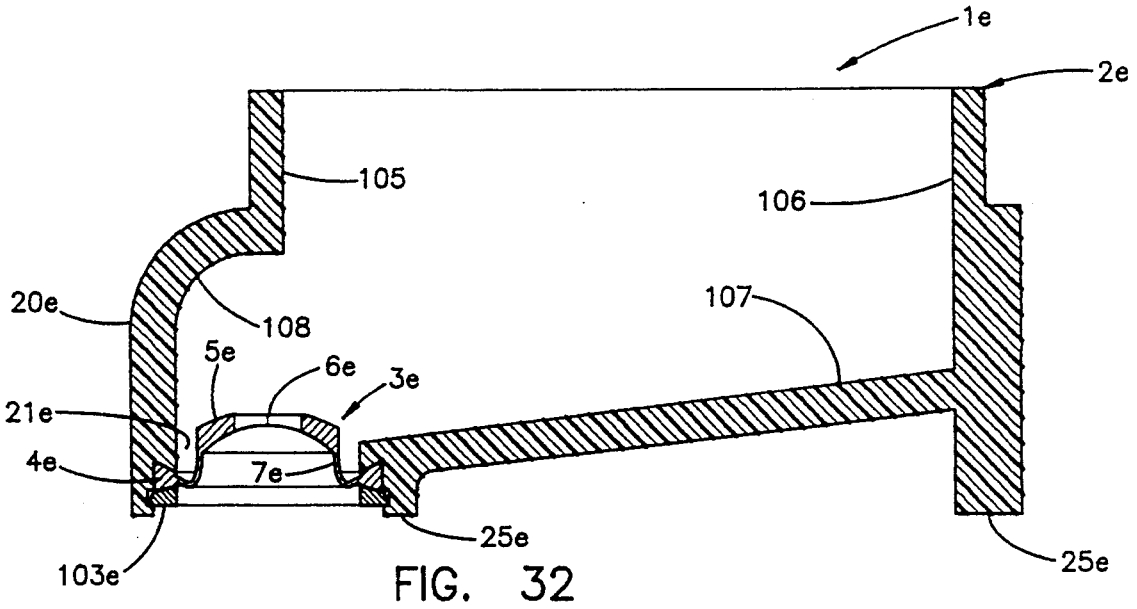
FIG. 32 is a partially schematic, cross-sectional view of yet another embodiment of the present dispensing package, wherein the valve is mounted in a sloped base portion of an associated container.

The reference numeral 1e (FIG. 32) generally designates yet another dispensing package embodying the present invention, having an inclined bottom dispense arrangement. Since dispensing package 1e is similar to the previously described dispensing packages 1–1d, similar parts appearing in FIGS. 1–31 and 32 respectively are represented by the same, corresponding reference numeral, except for the suffix "e" in the numerals of the latter. In the illustrated dispensing package 1e, container 2e is provided with a dispensing valve 3e mounted in a bottom portion thereof. Container 2e has flat bottom portions 25e adapted to abuttingly support dispensing package 1e on an associated surface, such as a countertop, sink, worksurface or the like. The interior of container 2e includes a downwardly opening neck 20e which defines a discharge opening 21e about which the marginal flange 4e of valve 3e is positioned. In the illustrated example, discharge opening 21e is positioned adjacent an edge area of the container bottom 25, so as to facilitate bottom dispensing liquid product from container 2e by improving aim control, and minimizing the amount of motion required to dispense product. The interior of container 2e includes sidewall surfaces 105 & 106 and a base surface 107. Sidewall surface 105 includes an outwardly protruding portion 108 which forms a cavity directly above dispensing valve 3e. The bottom surface 107 of container 2e is sloped or inclined downwardly from its outer edges to discharge opening 21e, so that all fluid product can be readily emptied from container 2e, without requiring reorientation from its normal upright position. In general, dispensing valve 3e operates in the same manner as dispensing valve 3, as illustrated in FIGS. 7–14, and described in the related specification.

Figure 33:
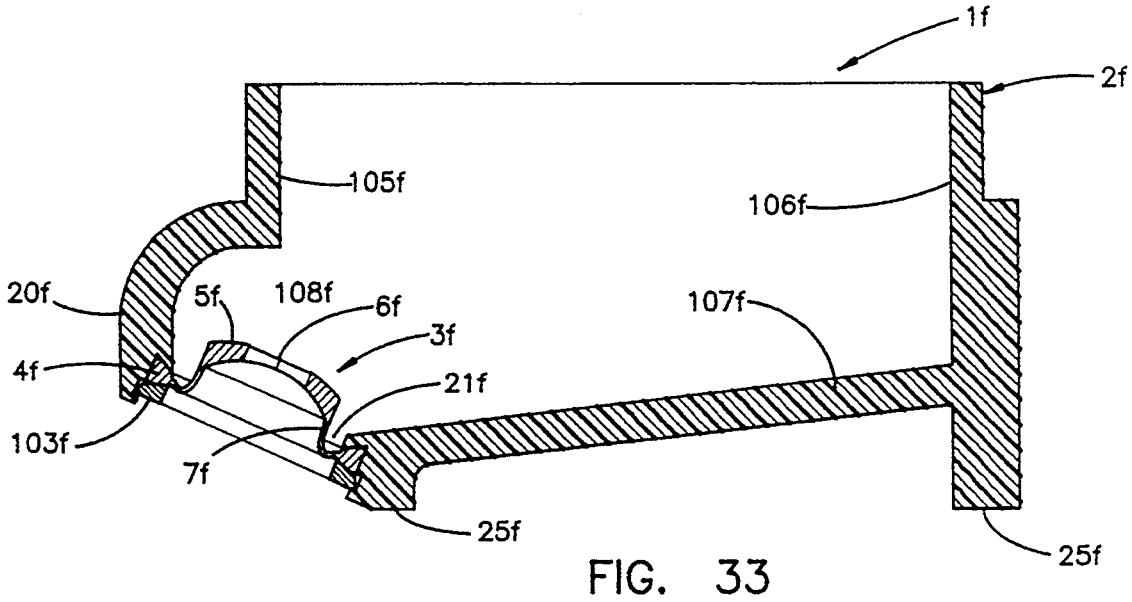
FIG. 33 is a partially schematic, cross-sectional view of yet another embodiment of the present dispensing package, wherein the valve is mounted at an angle in a sloped base portion of an associated container.

The reference numeral If (FIG. 33) generally designates yet another dispensing package embodying the present invention, having an angled bottom dispense feature. Since dispensing package if is similar to previously described dispensing packages 1–1e, similar parts appearing in FIGS. 1–32 and FIG. 33 respectively are represented by the same, corresponding reference numeral, except for the suffix "f" in the numerals of the latter. Dispensing package if is nearly identical to dispensing package 1e, except for the orientation of discharge opening 21f. In the illustrated dispensing package 1f, discharge opening 21f is oriented at an acute angle, in the range of 20–30 degrees, with respect to the base 25f of container 2f, and the associated dispensing valve 3f is similarly angularly oriented therein. As a consequence, dispensing from container if can be achieved with improved aim control, and perhaps in at least some instances, without moving dispensing package if from its set position. For instance, when dispensing package If is positioned on a support surface adjacent a wash area, such as a sink or the like, the angled orientation of discharge opening 21 and associated dispensing valve 3f will permit the user to dispense fluid product into the wash area by simply grasping and squeezing dispensing package 1f. The directional location of dispensing valve 38 facilitates accurately aiming the stream of fluid product from container 2f. Also, in such environments, the user may not be required to bodily transport dispensing package if over the wash area.

Figure 34:
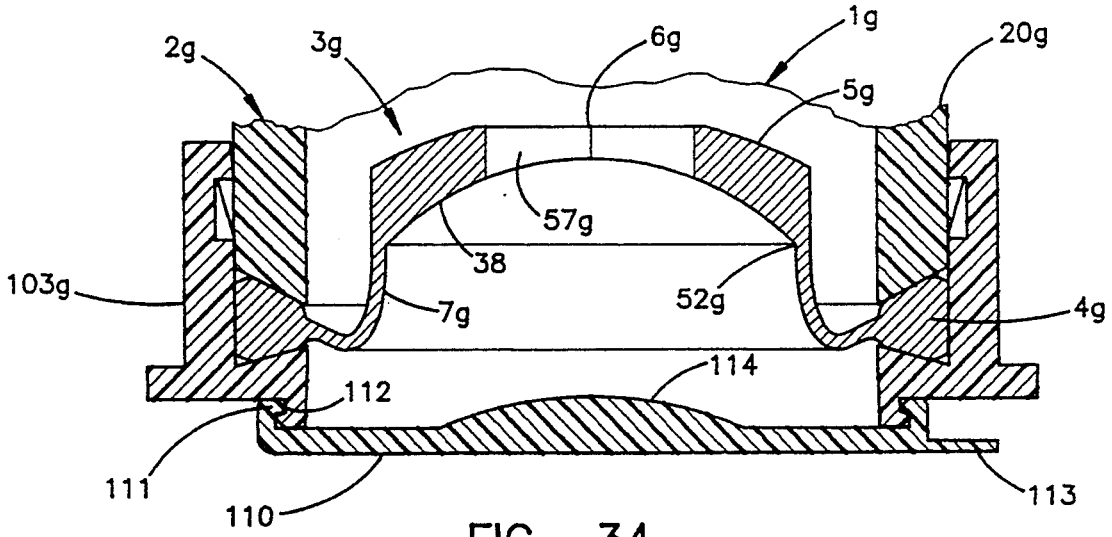
FIG. 34 is a partially schematic, cross-sectional view of yet another embodiment of the present dispensing package, wherein a cap is provided with a protuberance which positively prevents the valve from leaking.

The reference numeral 1g (FIG. 34) generally designates yet another dispensing package embodying the present invention, having a valve stop associated therewith. Since dispensing package 1g is similar to the previously described dispensing packages 1–1f, similar parts appearing in FIGS. 1–33 and 34 respectively are represented by the same, corresponding reference numeral, except for the suffix "g" in the numerals of the latter. In dispensing package 1g a travel closure 110 is positioned generally opposite the associated dispensing valve 3g. In the illustrated example, closure 110 is in the form of a flat cap, having a peripheral rib 111 which engages a mating groove 112 in container neck 20g to detachably retain the same in place with a snap lock. Closure cap 110 also includes an outwardly protruding tab 113 to facilitate removing closure cap 110 from container 1g. The interior surface of closure cap 110 includes an inwardly projecting protuberance or valve stop 114, which serves to positively prevent valve orifice 6g from leaking. In the illustrated example, protuberance 114 comprises an arcuately shaped dimple, which is located adjacent the central portion of closure cap 110, and is shaped generally similar to the exterior surface 38 of valve head 5g. As previously discussed, valve head 5g must assume an outwardly protruding configuration to shift discharge orifice 6 into the open position. When pressure is applied to container 2g, valve head 5g will extend rollingly outwardly into contact with closure cap 110, and abutting contact will be established between the interior surface 38 of valve head 5g, and arcuate dimple 114, which contact will positively prevent valve head 5g from leaking. Hence, discharge orifice 6g will remain completely sealed, even when dispensing package 1g is shaken vigorously, jarred, or the like. It is to be understood that dimple 114 may assume different shapes, and can be positioned opposite valve 3g by arrangements other than cap 110, and still serve effectively to prevent valve leakage.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of an invention in which an exclusive property or privilege is claimed are defined as follows.

1. A dispensing package for fluid products, comprising:

a container to retain a selected fluid product therein, having a discharge opening and flexible walls which collapse when fluid product is dispensed from said container; and a dispensing valve for controlling the flow of the fluid product from said container, including a marginal valve portion sealing about the discharge opening of said container; a valve head portion having an orifice which opens to permit fluid flow therethrough in response to a predetermined discharge pressure within said container, and closes to shut off fluid flow therethrough upon removal of the predetermined discharge pressure, wherein said valve head portion is shaped for shifting generally centrally with respect to said marginal valve portion; and a connector sleeve portion having a resiliently flexible construction, with one end area thereof connected with said marginal valve portion, and an opposite end area thereof connected with said valve head portion, wherein said connector sleeve portion has a configuration which applies an outwardly directed torque to said valve head portion when pressure within said container is raised above the predetermined discharge pressure to assist in opening said orifice, and applies an inwardly directed torque to said valve head portion when the predetermined discharge pressure within said container is released to assist in closing said orifice.

2. A dispensing package as set forth in claim 1, wherein:

said connector sleeve portion has a sidewall shaped to double over and extend and retract rollingly.

3. A dispensing package as set forth in claim 2, wherein:

said valve head portion is generally disc-shaped.

4. A dispensing package as set forth in claim 3, wherein:

said valve head portion includes a marginal area thereof adjacent which the other end area of said connector sleeve is connected.

5. A dispensing package as set forth in claim 4, wherein:

said sidewall of said connector sleeve portion flares outwardly from said valve head portion adjacent said marginal valve portion.

6. A dispensing package as set forth in claim 5, wherein:

said sidewall of said connector sleeve portion has a generally J-shaped longitudinal cross-sectional shape.

7. A dispensing package as set forth in claim 6, wherein:

said valve head portion is configured such that when said orifice is closed, an exterior surface thereof assumes a generally concave orientation as viewed from outside said container.

8. A dispensing package as set forth in claim 7, wherein:

said valve head portion is configured such that when said orifice is closed, an interior surface thereof assumes a generally convex orientation as viewed from inside said container.

9. A dispensing package as set forth in claim 8, wherein:

said exterior surface of said valve head portion is configured to protrude outwardly when said orifice is open.

10. A dispensing package as set forth in claim 9, wherein:

said container includes a collapsible bag.

11. A dispensing package as set forth in claim 10, wherein:

said bag includes a hanger.

12. A dispensing package as set forth in claim 11, wherein:

said dispensing valve is mounted adjacent a bottom portion of said bag.

13. A dispensing package as set forth in claim 1, wherein:

said valve head portion is generally disc-shaped.

14. A dispensing package as set forth in claim 1, wherein:

said valve head portion includes a marginal area thereof adjacent with the other end area of said connector sleeve is connected.

15. A dispensing package as set forth in claim 1, wherein:

said connector sleeve portion flares outwardly from said valve head portion adjacent said marginal valve portion.

16. A dispensing package as set forth in claim 1, wherein:

said connector sleeve portion has a generally J-shaped longitudinal cross-sectional shape.

17. A dispensing package as set forth in claim 1, wherein:

said valve head portion is configured such that when said orifice is closed, an exterior surface thereof assumes a generally concave orientation as viewed from outside said container.

18. A dispensing package as set forth in claim 1, wherein:

said valve head portion is configured such that when said orifice is closed, an interior surface thereof assumes a generally convex orientation as viewed from inside said container.

19. A dispensing package as set forth in claim 1, wherein:

said container includes a collapsible bag.

20. A dispensing package as set forth in claim 1, wherein:

said container includes a hanger.

21. A dispensing package as set forth in claim 1, wherein:

said dispensing valve is mounted adjacent a bottom portion of said container.

22. A dispensing package as set forth in claim 1, including:

a valve stop selectively associated with said container, and including a portion positioned generally opposite said dispensing valve to positively retain said orifice in a fully closed position.

23. A dispensing valve for fluid product packaging of the type having a container with a discharge opening, comprising:

a marginal valve portion shaped to seal about the discharge opening of the container; a valve head portion having an orifice which opens to permit fluid flow therethrough in response to a predetermined discharge pressure within the container, and closes to shut off fluid flow therethrough upon removal of the predetermined discharge pressure, wherein said valve head portion is shaped for shifting generally centrally with respect to said marginal valve portion; and a connector sleeve portion having a resiliently flexible construction, with one end area thereof connected with said marginal valve portion, and an opposite end area thereof connected with said valve head portion, wherein said connector sleeve portion has a configuration which applies an outwardly directed torque to said valve head portion when pressure within the container is raised above the predetermined discharge pressure to assist in opening said orifice, and applies an inwardly directed torque to said valve head portion when the predetermined discharge pressure within said container is released to assist in closing said orifice.

24. A dispensing valve as set forth in claim 23, wherein:

said connector sleeve portion has a sidewall shaped to double over and extend and retract rollingly.

25. A dispensing valve as set forth in claim 23, wherein:

said valve head portion is generally disc-shaped.

26. A dispensing valve as set forth in claim 23, wherein:

said valve head portion includes a marginal area thereof adjacent which the other end area of said connector sleeve is connected.

27. A dispensing valve as set forth in claim 23, wherein:

said connector sleeve portion flares outwardly frown said valve head portion adjacent said marginal valve portion.

28. A dispensing valve as set forth in claim 23, wherein:

said connector sleeve portion has a generally J-shaped longitudinal cross-sectional shape.

29. A dispensing valve as set forth in claim 23, wherein:

said valve head portion is configured such that when said orifice is closed, an exterior surface thereof assumes a generally concave orientation as viewed from outside the container.

30. A dispensing valve as set forth in claim 23, wherein:

said valve head portion is configured such that when said orifice is closed, an interior surface thereof assumes a generally convex orientation as viewed from inside the container.

31. A dispensing valve for fluid product packaging of the type having a container with a discharge opening; said dispensing valve comprising:

a marginal valve portion shaped to seal about the discharge opening of tile container; a connector sleeve portion having a resiliently flexible construction, with one end area thereof connected with said marginal valve portion; and a valve head portion connected with an opposite end area of said connector sleeve portion, and having an orifice which opens to permit fluid flow therethrough in response to a predetermined discharge pressure within the container, and closes to shut off fluid flow therethrough upon removal of the predetermined discharge pressure; said valve head portion having an outwardly flared crown shape, wherein a marginal edge of said valve head portion tapers radially inwardly toward said connector sleeve portion to alleviate nesting during handling.

32. A dispensing package as set forth in claim 31, wherein:

said valve head portion is configured such that when said orifice is closed, an exterior surface thereof assumes a generally concave orientation as viewed from outside said container.

33. A dispensing package as set forth in claim 32, wherein:

said valve head portion is configured such that when said orifice is closed, an interior surface thereof assumes a generally convex orientation as viewed from inside said container.

34. A dispensing package as set forth in claim 33, wherein:

said valve head interior surface is sufficiently large with respect to the one end area of said connector sleeve portion to alleviate nesting with similar dispensing valves.

35. A dispensing package as set forth in claim 34, wherein:

said valve head portion has a thickness defined between said interior surface and said exterior surface which tapers inwardly to a thinnest area thereof adjacent said orifice to facilitate the suck back of air into the container.

36. A dispensing package for fluid products, comprising:

a container for retaining a selected fluid product therein, having a base shaped to support said container in an upright, freestanding orientation on a selected surface, and including a discharge opening therein through which fluid product is dispensed from said container:

a dispensing valve for controlling the flow of the fluid product from said container, including a marginal valve portion sealing about the discharge opening of said container: a valve head portion having an orifice which opens to permit fluid flow therethrough in response to a predetermined discharge pressure within said container, and closes to shut off fluid flow therethrough upon removal of the predetermined discharge pressure, wherein said valve head portion is shaped or shifting generally centrally with respect to said marginal valve portion; and a connector sleeve portion having a resiliently flexible construction, with one end area thereof connected with said marginal valve portion, and an opposite end area thereof connected with said valve head portion, wherein said dispensing valve is oriented in said container such that said predetermined threshold pressure is greater than the maximum hydraulic head pressure of the fluid product in said container when said discharge opening is oriented downwardly to prevent inadvertent leakage of the liquid product from said dispensing package; and wherein said discharge opening is positioned adjacent an edge area of said base to facilitate accurately dispensing the fluid product through said valve;

said base includes an interior wall which tapers downwardly to said edge area and said discharge opening from an opposite edge area thereof to insure complete emptying of fluid product from said dispensing package.

37. A dispensing package as set forth in claim 36, wherein:

said dispensing valve is oriented at an angle to the selected surface when said container is supported in an upright, freestanding orientation thereon.

38. A dispensing package as set forth in claim 37, wherein:

said valve head portion is configured such that when said orifice is closed, an exterior surface thereof assumes a generally concave orientation as viewed from outside said container.

39. A dispensing package as set forth in claim 38, wherein:

said valve head portion is configured such that when said orifice is closed, an interior surface thereof assumes a generally convex orientation as viewed from inside said container.

40. A dispensing package as set forth in claim 39, wherein:

said exterior surface of said valve head portion is configured to protrude outwardly when said orifice is open.

41. A dispensing package as set forth in claim 40, wherein;

said connector sleeve portion has a sidewall shaped to double over and extend and retract rollingly.

42. A dispensing package as set forth in claim 41, wherein:

said sidewall of said connector sleeve portion has a generally J-shaped longitudinal cross-sectional shape.

* * * * *

UNITED STATES PATENT AND TRADEMARK OFFICE

CERTIFICATE OF CORRECTION

PATENT NO. : 5,377,877

DATED : January 3, 1995

INVENTOR(S) : Paul E. Brown et al.

It is certified that error appears in the above-indentified patent and that said Letters Patent is hereby corrected as shown below:

Column 6, line 8
After "portion" delete --.--;

Column 10, line 15
"produce 18" should be --product 18--;

Column 12, line 48
"desire" should be --desired--;

Column 24, line 26
"4c of valve 3c" should be --4d of valve 3d--;

Column 26, line 8
"numeral If" should be --numeral 1f--;

Column 26, line 11
"package if" should be --package 1f--;

Column 26, line 16
"package if" should be --package 1f--;

Column 26, line 23
"container if" should be --container 1f--;

Column 26, lines 25 and 26
"package if" should be --package 1f--;

Column 26, line 27
"package If" should be --package 1f--;

Column 26, line 36
"package if" should be --package 1f--;

UNITED STATES PATENT AND TRADEMARK OFFICE

CERTIFICATE OF CORRECTION

PATENT NO. : 5,377,877

DATED : January 3, 1995

INVENTOR(S) : Paul E. Brown et al.

It is certified that error appears in the above-indentified patent and that said Letters Patent is hereby corrected as shown below:

Column 29, line 49, Claim 27
"frown" should be --from--;

Column 30, line 5, Claim 31
"tile" should be --the--; and

Column 30, line 62, Claim 36
"shaped or" should be --shaped for--.

Cover Sheet, Item 73, Assignee Address
"Wis." should be --Mich.--.

Signed and Sealed this

Third Day of October, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,377,877
DATED : January 3, 1995
INVENTOR(S) : Paul E. Brown et al.

It is certified that error appears in the above-identified patent and that said Letters Patent is hereby corrected as shown below:

Title page,
Item [*] Notice, "May 25, 2010" should read -- the expiration of the full statutory term of U.S. Patent No. 5,213,236 --.

Signed and Sealed this

Fifteenth Day of February, 2005

JON W. DUDAS
*Director of the United States Patent and Trademark Office*